US007628182B2

(12) United States Patent
Poulter et al.

(10) Patent No.: US 7,628,182 B2
(45) Date of Patent: Dec. 8, 2009

(54) MODULAR MULTI-PORT MANIFOLD AND FUEL DELIVERY SYSTEM

(75) Inventors: Trevor J. Poulter, Horsforth (GB); Francis V. Stemporzewski, Jr., Salem, NH (US); Kevin K. Nussair, Independence, MO (US)

(73) Assignee: Delaware Capital Foundation, Inc., Wilmington, DE (US)

( * ) Notice: Subject to any disclaimer, the term of this patent is extended or adjusted under 35 U.S.C. 154(b) by 356 days.

(21) Appl. No.: 10/993,177

(22) Filed: Nov. 19, 2004

(65) Prior Publication Data

US 2005/0139286 A1 Jun. 30, 2005

Related U.S. Application Data

(60) Provisional application No. 60/524,379, filed on Nov. 20, 2003, provisional application No. 60/565,625, filed on Apr. 27, 2004.

(51) Int. Cl.
*B65B 1/04* (2006.01)

(52) U.S. Cl. ..... 141/244; 141/231; 141/237; 137/263

(58) Field of Classification Search ..... 141/100–105, 141/231, 234, 237, 244; 222/185.1, 181.1; 137/263

See application file for complete search history.

(56) References Cited

U.S. PATENT DOCUMENTS

| | | | | | |
|---|---|---|---|---|---|
| 2,160,741 | A | * | 5/1939 | Jensen et al. | 137/246.14 |
| 2,608,988 | A | * | 9/1952 | Ziegler | 137/263 |
| 3,580,420 | A | * | 5/1971 | Kennedy et al. | 222/1 |
| 3,807,433 | A | * | 4/1974 | Byrd | 137/255 |
| 4,139,019 | A | * | 2/1979 | Bresie et al. | 137/351 |
| 4,320,788 | A | * | 3/1982 | Lord | 141/290 |
| 5,944,074 | A | * | 8/1999 | Leahy et al. | 141/192 |

* cited by examiner

*Primary Examiner*—Timothy L Maust
(74) *Attorney, Agent, or Firm*—Chase Law Firm, L.C.

(57) ABSTRACT

A modular multi-port manifold and fuel delivery system includes a plurality of ports in fluid communication with corresponding compartments of a fuel delivery vehicle, a collector conduit common to the ports, a control valve associated with each port to control flow of the fuel product from the associated compartment to the collector conduit to deliver the product, and a control system for operating each of the control valves.

43 Claims, 19 Drawing Sheets

MODULAR MULTI-PORT MANIFOLD AND FUEL DELIVERY SYSTEM

CROSS REFERENCE TO RELATED APPLICATIONS

This application claims the benefit of prior filed, application Ser. No. 60/524,379, filed Nov. 20, 2003, entitled MODULAR MULTI-PORT MANIFOLD AND FUEL DELIVERY SYSTEM, and Ser. No. 60/565,625, filed Apr. 27, 2004, entitled MODULAR MULTI-PORT MANIFOLD AND FUEL DELIVERY SYSTEM.

FIELD OF THE INVENTION

This invention relates to manifolds for fuel delivery vehicles and, in particular, to a modular manifold with multiple ports.

BACKGROUND OF THE INVENTION

Loading and off-loading of petroleum products into the tank compartments of transport trucks and from the tank compartments into various types of storage tanks are common procedures known in the art. A tank truck may have a tank with two or more separate compartments which often contain different fuels such as various grades of unleaded gasoline, diesel, fuel oils and kerosene. The tank truck typically features a manifold comprised of individual liquid connections for each of the tank compartments, with a manual shutoff valve at the end of each connection to control the product flow out of the compartment. When dispensing the products, the truck driver typically connects short sections of hose from the compartment being dispensed to the suction intake connection of one of the pumps on the truck. Once connected, the driver manually opens the proper shutoff valve to allow the product to flow out of the compartment and into the pump suction intake. The truck driver must take care to not mix the products by connecting the wrong fuel type to the wrong pump suction intake. Additionally, during this manual connection and disconnection of the short hoses between the different truck tank compartments and the pump suction intakes, a large quantity of fuel may be spilled from these hoses. It is also common practice for the driver to have to return product to a tank compartment from a delivery hose in order to clear that hose of one product before dispensing the next dissimilar one. This generally requires the driver to climb on top of the tank truck with the delivery hose and open the manhole on the top of the tank compartment in order to discharge the product back into the tank.

Prior art manifolds are typically manufactured for a particular truck and sized according to the number of compartments. The typical life of a tank truck chassis is from seven to ten years, with the life of a manifold of fourteen to twenty years. When a tank truck chassis is retired, the manifold may be removed and installed on another tank on another truck chassis. However, these manifolds have a fixed size and thus are only usable on trucks that have the same number of compartments as the retired trucks from which the manifolds were removed. Having been manufactured for a specific number of compartments, this can cause delays and inconvenience in the manufacture of new tank trucks as well because each truck, depending on the number of compartments, is matched with a manifold of corresponding size necessitating the ordering or stocking of many different manifold sizes and styles by a tank truck manufacturer.

Furthermore, in prior art systems, access to the API fuel loading and unloading valves on the side of the tank truck may be restricted only by a lock on the API cap or by a cabinet enclosure around the API adaptors with a lock on the door. These locks may be easily overcome to gain access to the fuel.

Additionally, when dispensing a product, a driver may inadvertently pump the product into the wrong storage tank. For example, the driver may inadvertently unload gasoline into a diesel storage tank resulting in product loss and the added time and expense to clean out the storage tank, as well as the inherent safety risks associated with the wrong product ending up in the wrong storage tank.

SUMMARY OF THE INVENTION

A modular manifold is provided which includes one or more ports with one or more cylinder valves which control delivery of a product through one or more isolated collectors. The collectors are connected to the product pumps to deliver the product without having to swap hoses. The cylinders are pneumatically controlled by a control system in conjunction with an encoded product grade indicator which does not permit incompatible products to mix in a collector. An operator interface may be located remotely from the control system. Inserts may be used in the collectors to help the collectors drain when the tank truck is parked on a hill or inclined surface. API bottom loading valves may be secured to the manifold to load and unload the products from the compartments of the tank. A pneumatically locked guard bar may be employed to prevent access to API valve caps and prevent opening of the API valves when in the locked position. A return spout may be integrated with a section of the manifold to allow return of any product remaining in the line to the associated compartment after delivery of the product. An indicator on top of each cylinder may provide a visual indication of which cylinder is open.

DETAILED DESCRIPTION

Figure 1:
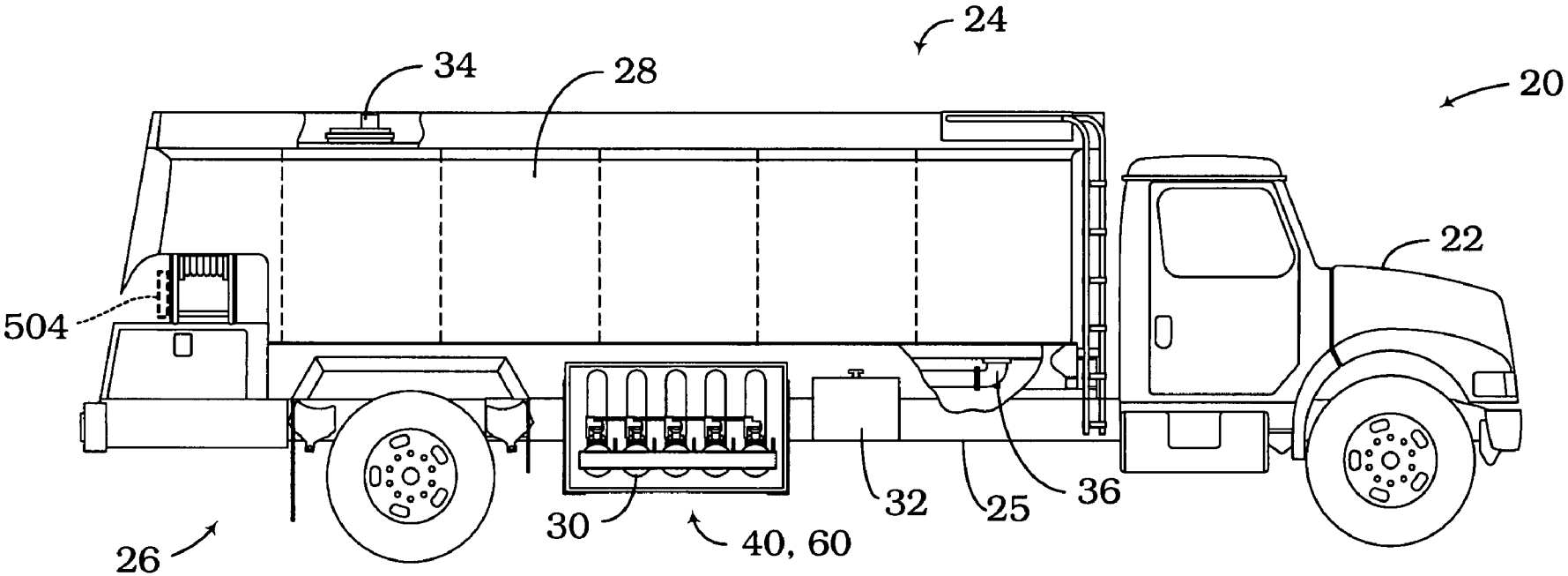
FIG. 1 is an illustrative side view of a tank truck.

Referring to FIG. 1, a tank truck for delivery of petroleum fuels is generally indicated by reference numeral 20. Tank truck 20 includes a cab 22 and tank 24 attached to the frame 25 of a trailer 26. The tank 24 is typically divided into separate compartments 28 such as five as illustrated. Fuel may be loaded into the compartments 28 through API bottom loading valves 30 and a multi-port manifold 40 or 60. A main control panel mounted in a main control housing 32 is used by an operator to monitor and control the loading, delivery and unloading processes of the fuels, as described more fully below. Each compartment 28 in tank 24 has a top vent 34 and a bottom emergency/drain valve 36.

Figure 2:
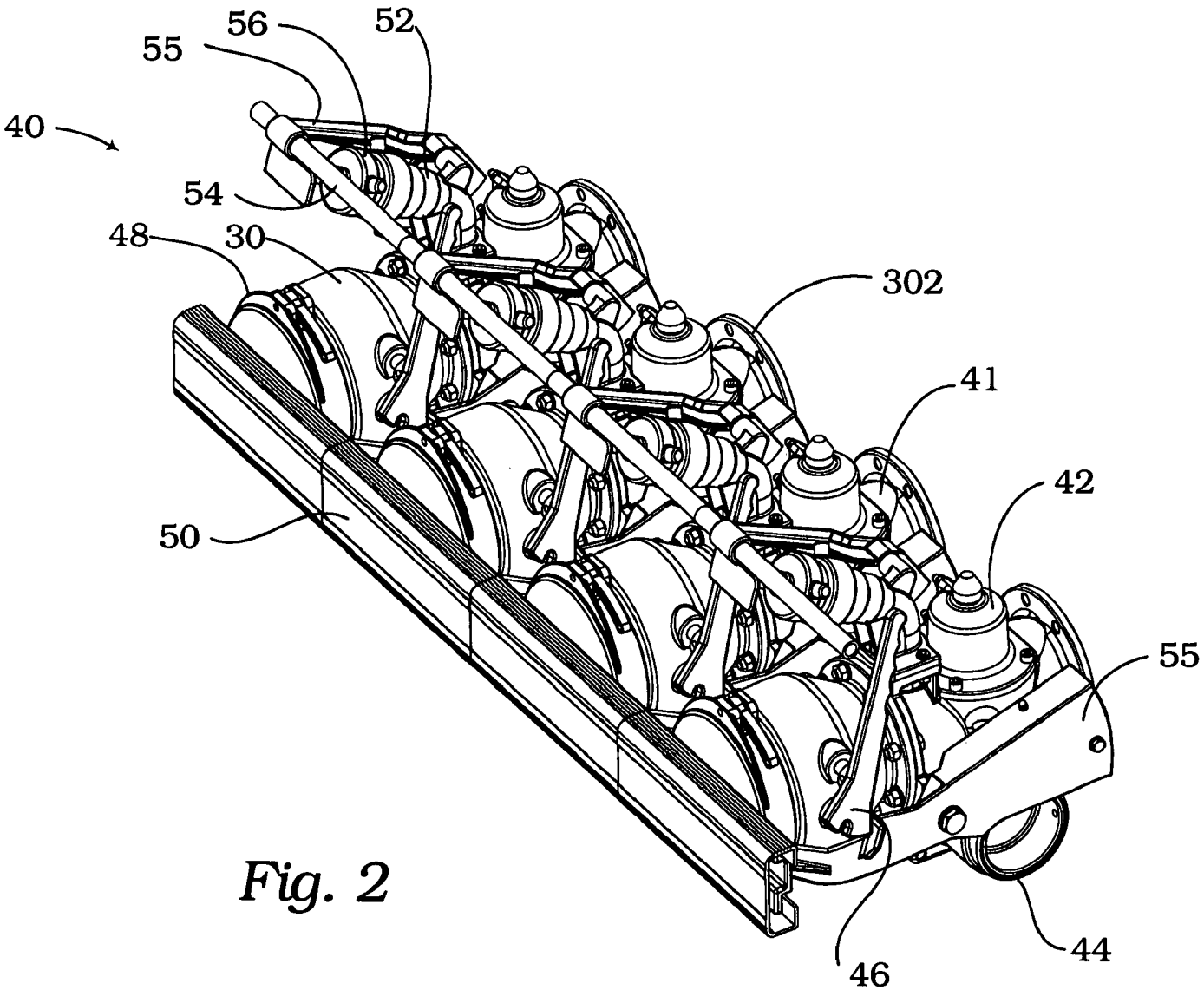
FIG. 2 is a perspective view of an embodiment of a modular manifold system of the present invention having four ports and a single collector looking downwardly thereon from one end.
Figure 3:
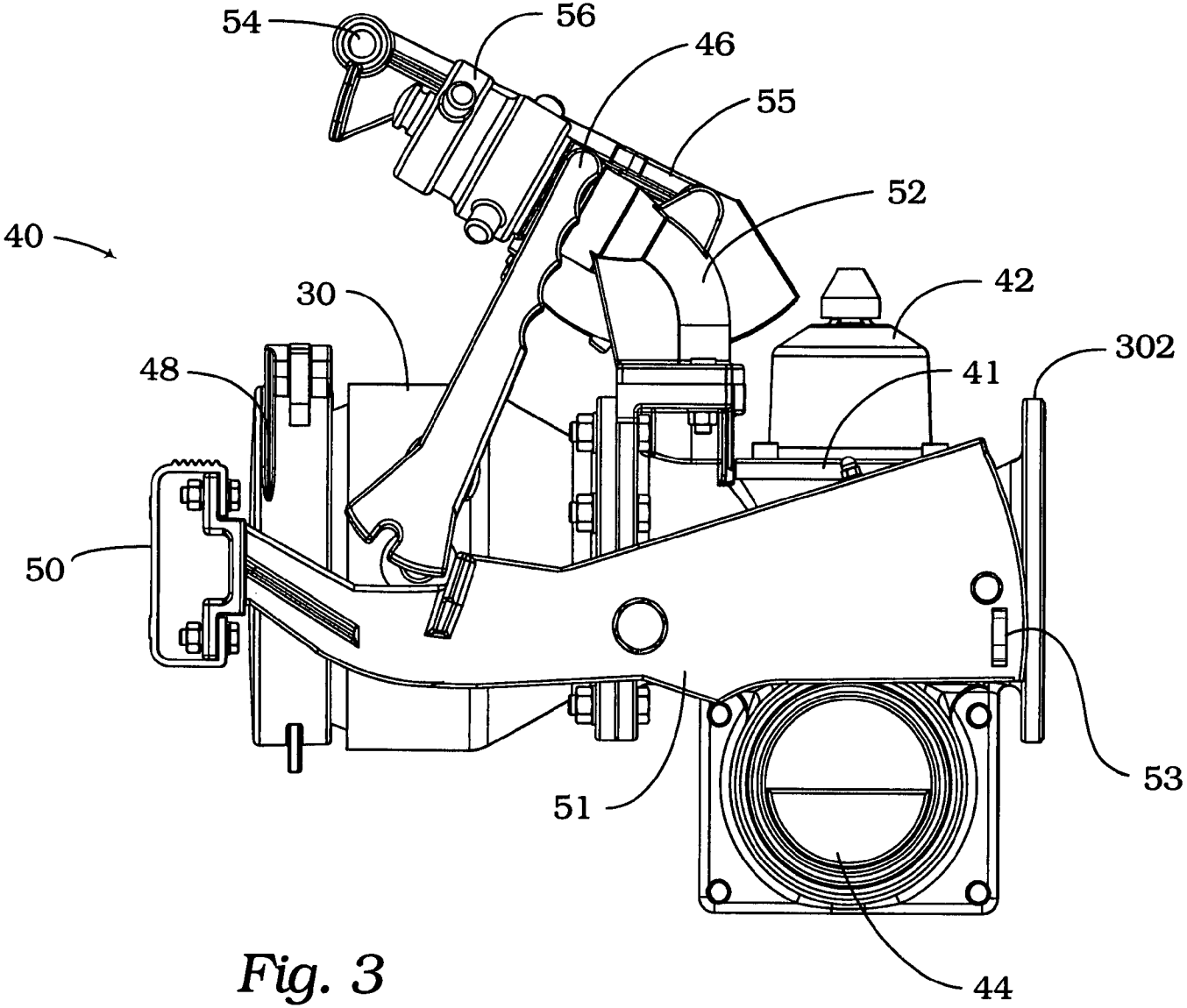
FIG. 3 is an enlarged end view of the manifold of FIG. 2.

As shown in FIGS. 2 and 3, the API bottom loading valves 30 are secured to a modular multi-port manifold with a single collector, generally indicated by reference numeral 40. Manifold 40 is secured to the frame 25 of trailer 26 (see FIG. 1). The manifold 40 includes four ports 41, each communicating with a corresponding cylinder 42 mounted to the top of the port 41 above a collector 44. As shown in FIG. 2, the modular multi-port manifold 40 is configured with four ports 41, each with a control valve cylinder 42. An API valve 30 is bolted to the front of each port 41 of manifold 40. The four ports 41 are defined by a row of generally parallel sleeves that project outwardly from the truck frame 25, the inner end of each sleeve being secured to frame 25 by a coupling flange 302 in register with a corresponding fuel delivery pipe 206 (see FIG. 12) that communicates with a particular tank compartment 28. As the ports 41 are structurally independent, the manifold 40 is universal and may be used with any number of compartments by providing a like number of ports interconnected by one or more common collectors as will be discussed below.

Access to the handles 46 and caps 48 secured to the API valves 30 is restricted by a guard bar 50, which is pneumatically locked by the monitoring and control system (see FIGS. 9*a* and 9*b*), and by a spring catch 53. Guard bar 50 is secured to the free ends of guard bar arms 51 which are pivotally secured to the manifold port 41. The spring catch 53 is provided to ensure that the guard bar 50 cannot be accidentally raised by either the driver or by external forces such as vibrations from the truck hitting a pot hole, for example. To raise the guard bar 50, the driver pushes the catch 53 back against a spring which releases the guard bar arm 51. The catch 53 is self setting in that when the guard bar arm 51 is lowered the guard bar arm 51 rides up on a cam (not shown) on the catch 53 to force the catch out of the way and compress the spring until it clears the catch which locks the arm 51 in place.

A return spout 52 is secured to each port of the multi-port manifold 40. The return spout 52 allows an operator to return fuel remaining in a delivery hose (not shown) to the respective compartment 28. A return bar 54 secured to the free ends of return bar arms 55, obstructs access to the return spouts 52 and caps 56. Return bar arms 55 are pivotally secured to the return spouts 52. The return bar 54 may be pivoted upwardly which activates a product return roller valve (discussed hereinbelow) to open the drain valves 36 and vent valves 34 in the compartments 28 and apply the truck's parking brakes by applying air pressure on line 168 (see FIGS. 9*a* and 9*b*). The return spout 52 may include a sight glass 57 (see FIGS. 14 and 15) to allow the operator to see the product being returned.

Figure 12:
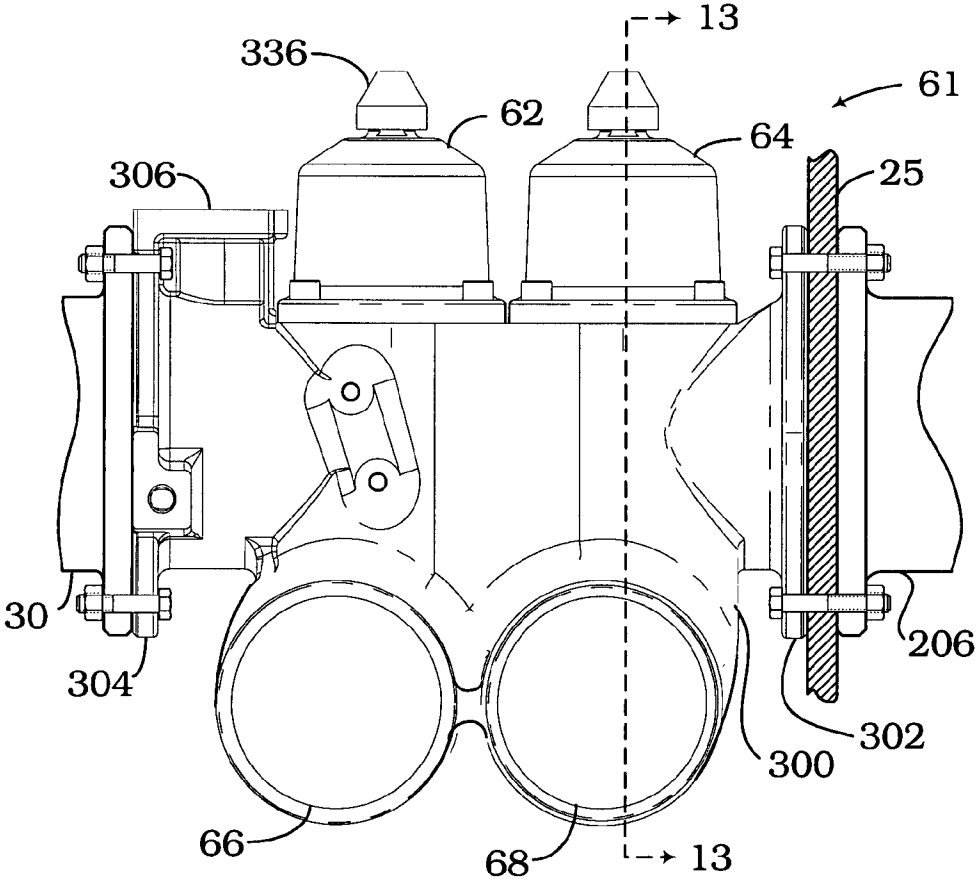
FIG. 12 is an end view of the dual-collector manifold of FIG. 4.

Each port 41 of the multi-port manifold 40 is connected to a compartment 28 of tank 24 by a pipe 206 as illustrated in FIG. 12. As shown in FIG. 2, the multi-port manifold 40 corresponds to a four compartment tank 24. The cylinders 42, in conjunction with the drain valves 36 (see FIG. 1), control the flow of fuel from a compartment 28 in tank 24 into the collector 44 of manifold 40.

Figure 4:
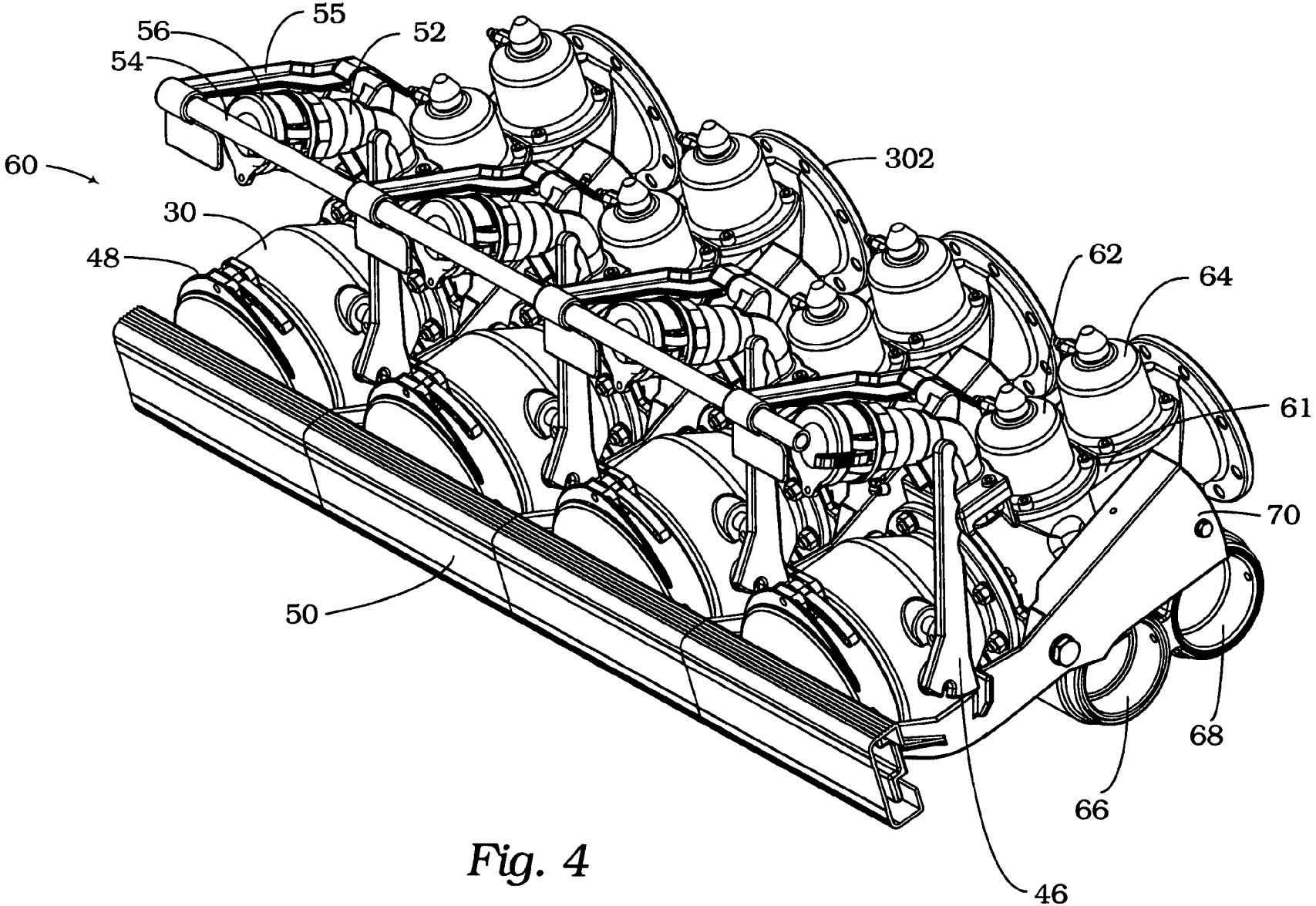
FIG. 4 is a perspective view similar to FIG. 2 of a modular manifold system of the present invention having four ports and a dual collector looking downwardly thereon from one end.
Figure 5:
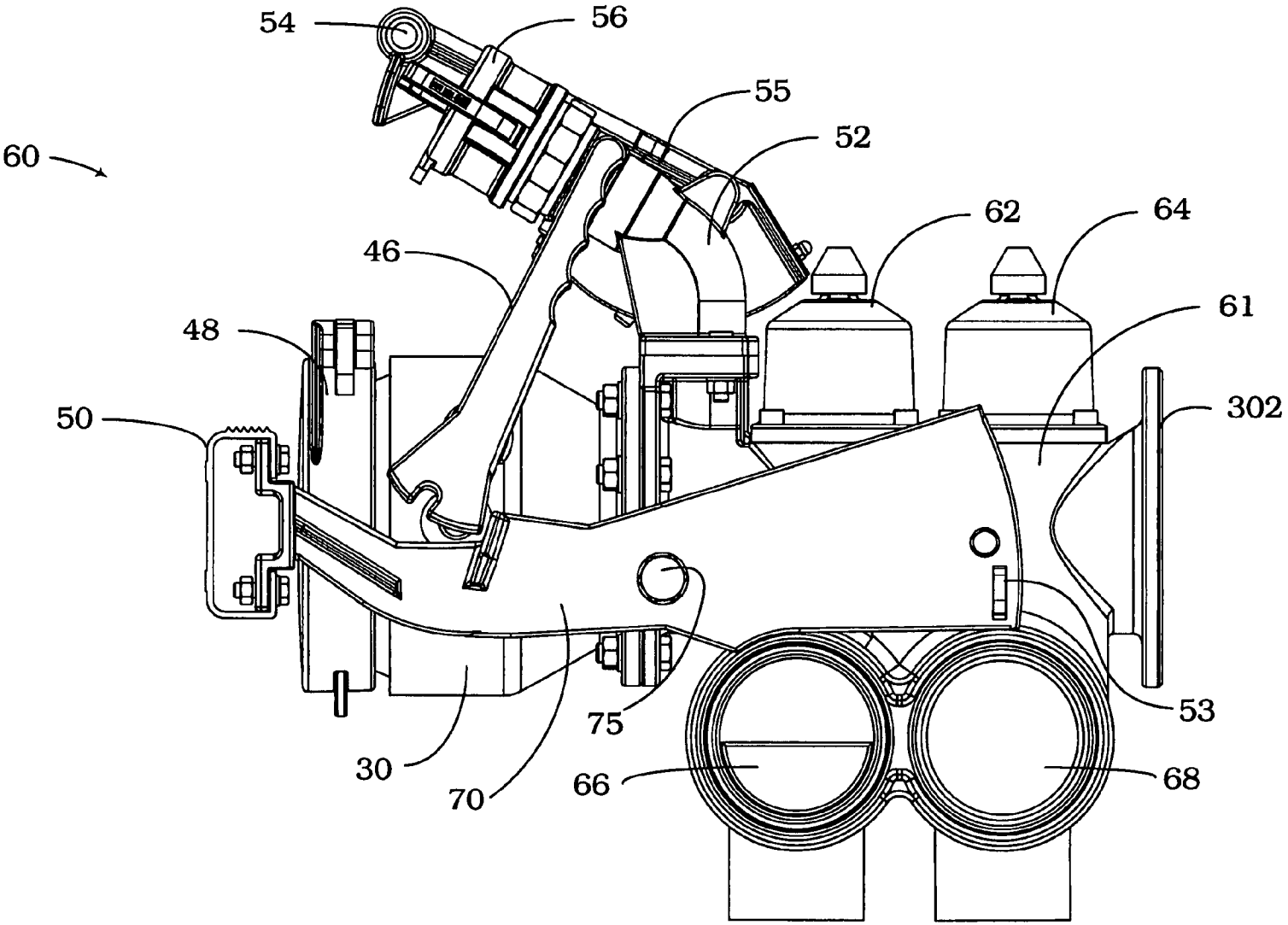
FIG. 5 is an enlarged end view of the manifold of FIG. 4.

Referring to FIGS. 4 and 5, a modular multi-port manifold with dual collectors is generally indicated by reference numeral 60. Like reference numerals designate the same components discussed hereinabove for the single collector manifold. Manifold 60 is secured to frame 25 of trailer 26. Manifold 60 includes ports 61, front 62 and rear 64 cylinders mounted to the top of each port 61 above front and rear collectors 66 and 68 extending in parallelism beneath the cylinders 62 and 64. As shown in FIG. 4, modular multi-port manifold 60 is configured with four ports 61, each with a pair of cylinders 62 and 64. An API valve 30 is bolted to the front of each port 61 of manifold 60.

Figure 9A:
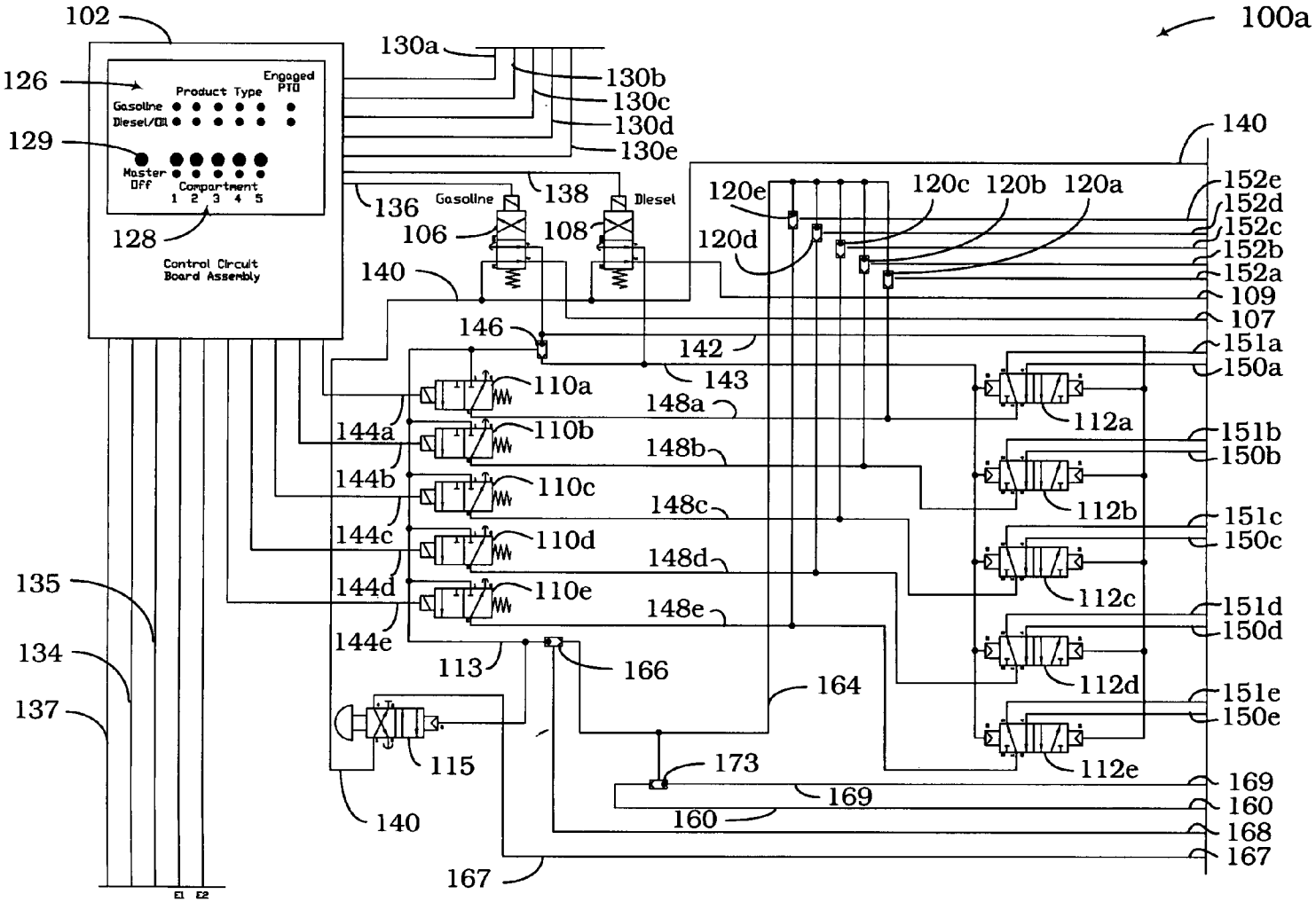
FIG. 9*a* is a pneumatic control schematic of the components located inside the main control housing of a modular manifold system configured for five ports.
Figure 9B:
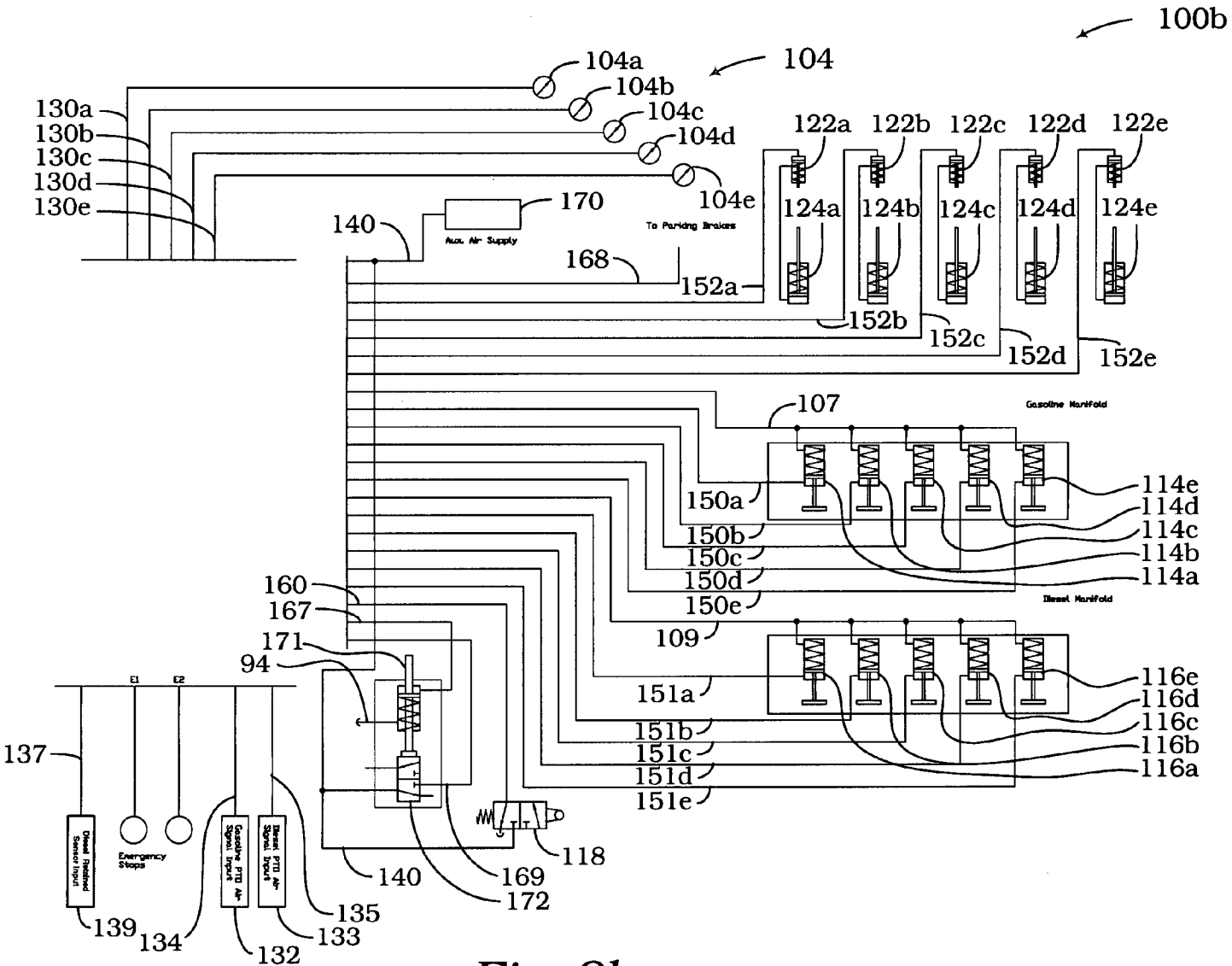
FIG. 9*b* is a pneumatic control schematic of the components located outside the main control housing of the modular manifold system configured for five ports.

Access to the handles 46 and caps 48 secured to the API valves 30 is restricted by a guard bar 50, which is pneumatically controlled by the monitoring and control system (see FIGS. 9*a* and 9*b*). Guard bar 50 is secured to the free ends of guard bar arms 70 which are pivotally secured to the manifold port 61.

One return spout 52 is secured to each port of the multi-port manifold 60. The return spout 52 allows an operator to return fuel remaining in a delivery hose (not shown) to the respective compartment 28. The return bar 54 secured to the free ends of return bar arms 55, obstructs access to the return spouts 52 and caps 56. Return bar arms 55 are pivotally secured to the return spouts 52. The return bar 54 may be pivoted upwardly which activates a product return roller valve (discussed hereinbelow) to open the drain valves 36 and vent valves 34 in the compartments 28 and apply the truck's parking brakes by applying air pressure on line 168.

Figure 10:
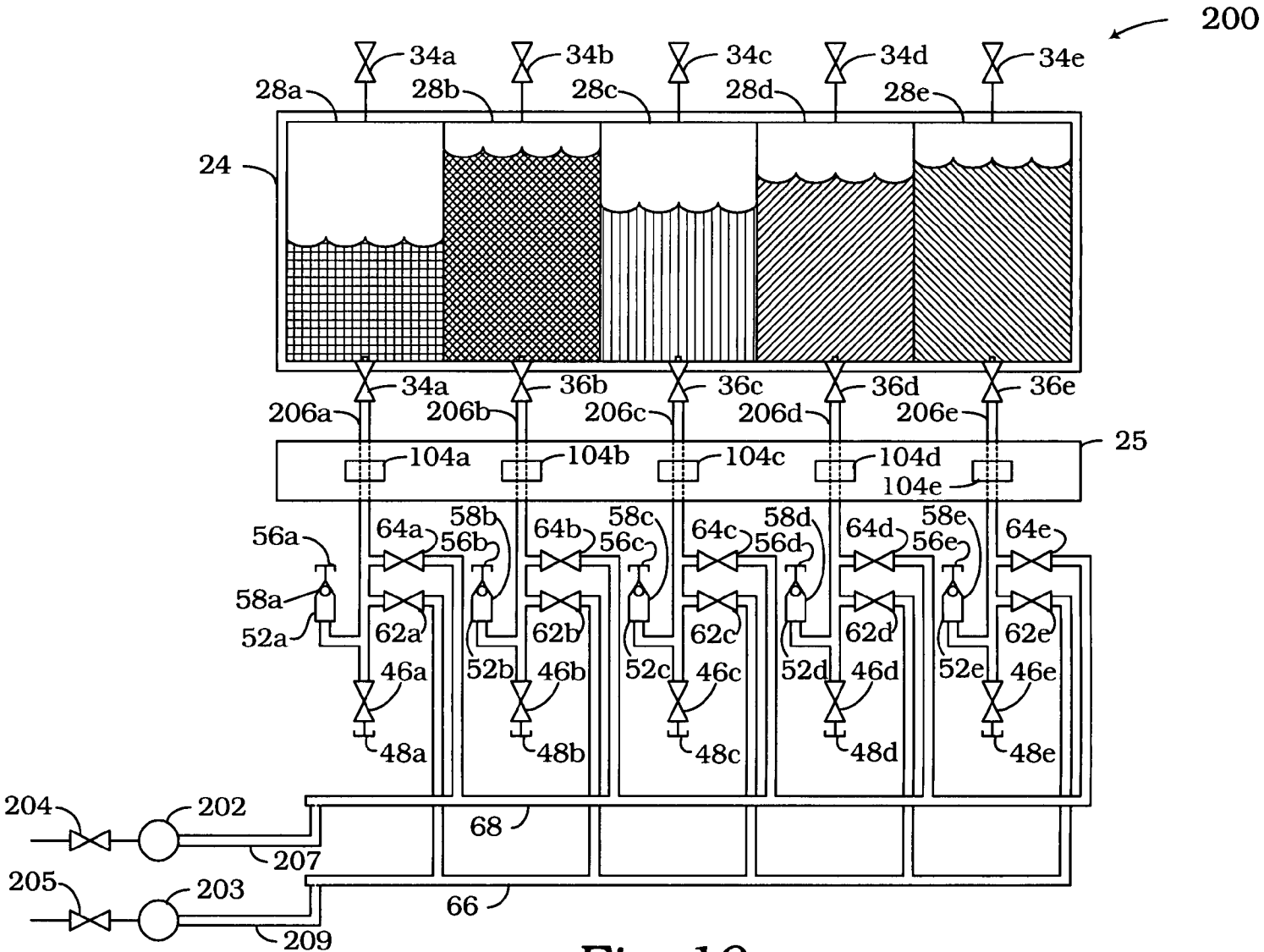
FIG. 10 is a fluid flow diagram of the five-port manifold system of FIGS. 9*a* and 9*b*.
Figure 11:
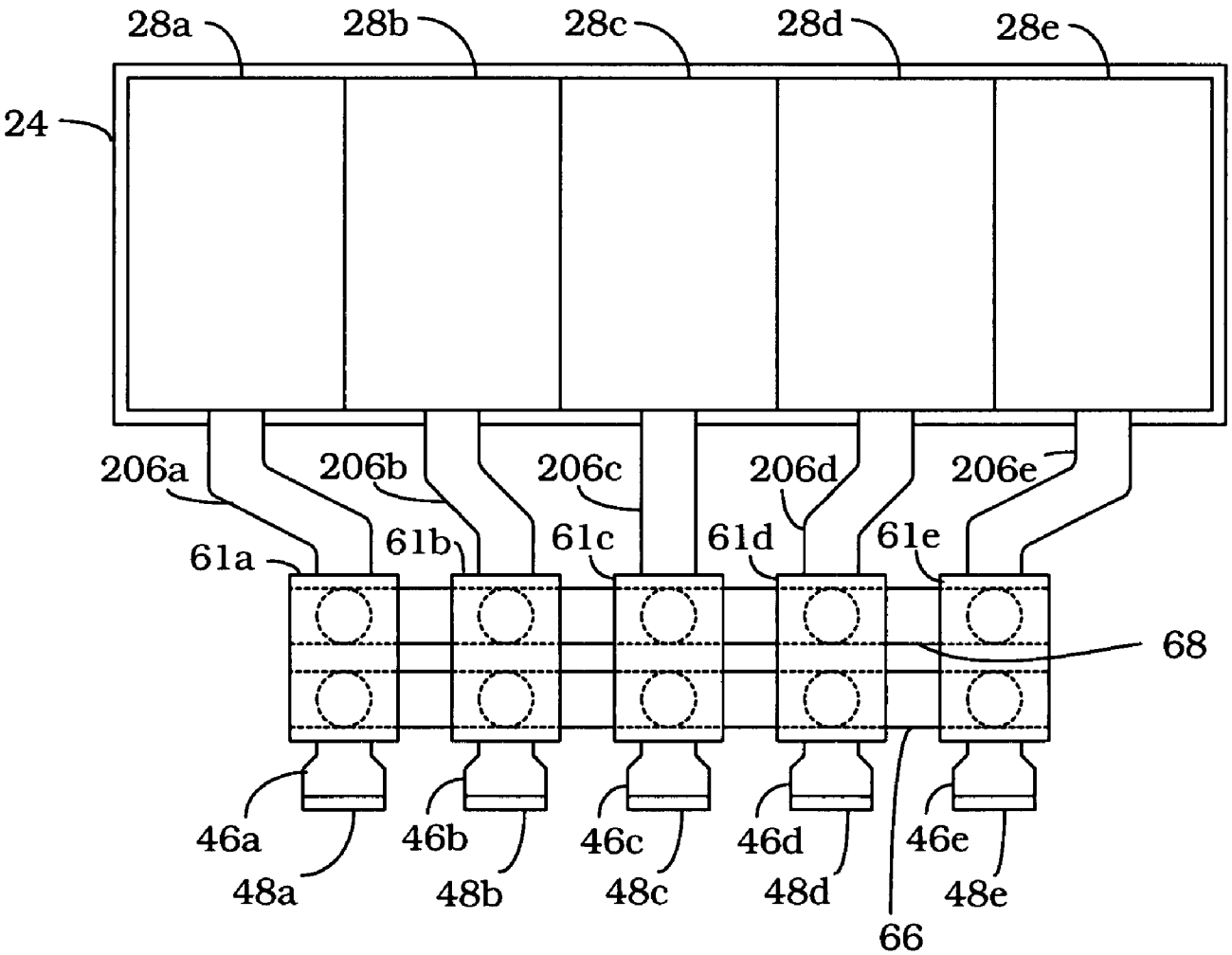
FIG. 11 is a diagrammatic illustration of the five-port manifold system of FIGS. 9*a* and 9*b*.

Each port 61 of manifold 60 is connected to a corresponding compartment 28 of tank 24 by a pipe (see FIGS. 10 and 11). As illustrated in FIG. 4, the multi-port manifold 60 corresponds to a four-compartment tank 24. The cylinders 62 and 64, in conjunction with the drain valves 36 (see FIG. 1), control the flow of fuel from a compartment 28 in tank 24 into collector 66 or 68 of manifold 60.

Figure 7:
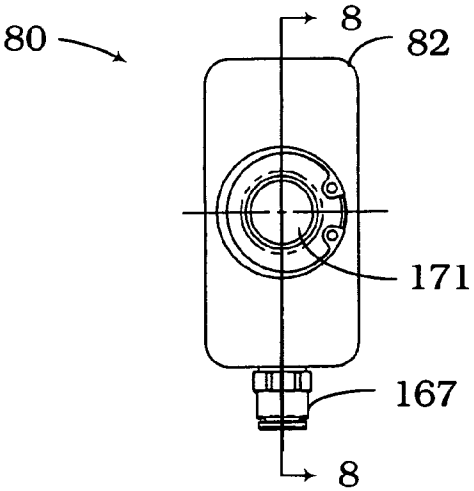
FIG. 7 is a side view of the guard bar lock cylinder of FIG. 6.
Figure 8:
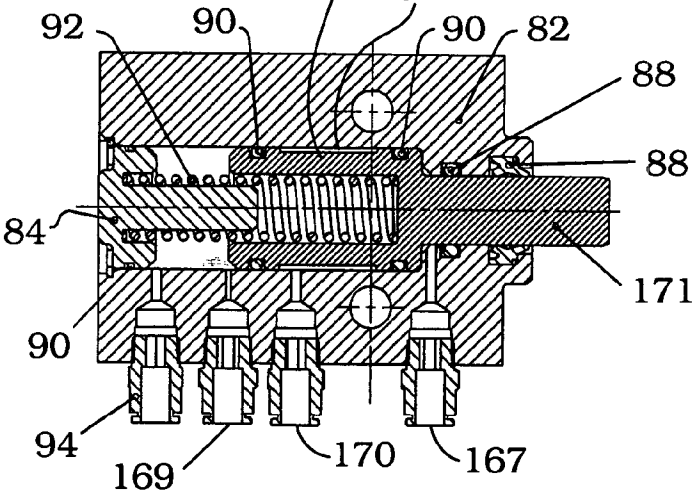
FIG. 8 is a sectional view of the guard bar lock cylinder taken along line 8-8 of FIG. 7.
Figure 6:
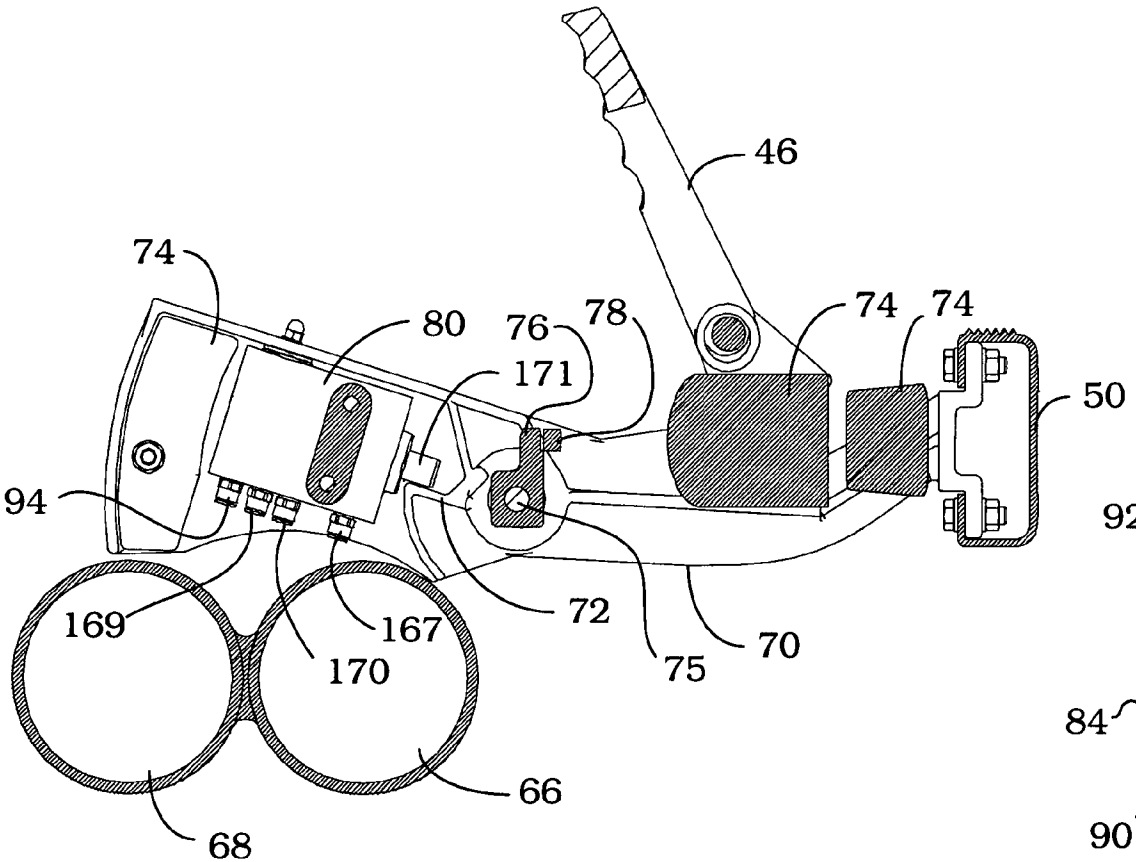
FIG. 6 is a partial opposite end view of the guard bar and arm of FIG. 4.

Referring to FIGS. 6-8, guard bar arm 70 includes a latch 72 which engages pneumatically controlled lock pin 171 to prevent the guard bar 50 from being lowered when the lock pin 171 is extended. Weights 74 are attached toward the front and rear of guard bar arm 70 to balance the arm 70 about the pivot point 75 for ease of operation and to reduce stress on the lock pin 171 due to the road shock and vibration. When the guard bar arm 70 is in the locked position as shown in FIG. 6, API valve handle 46 is obstructed and thus cannot be operated to open an API valve. A pair of magnets 76 and 78 hold the arm 70 in the locked position with the lock pin 171 not in contact with the latch 72 to further reduce stress on the lock pin 171 due to road vibrations during normal operation of the truck.

Referring to FIGS. 6-9*b*, pneumatically controlled lock pin 171 is actuated by a guard bar lock cylinder 80 that includes a housing 82, an end cap 84, a piston 86, wiper seals 88, O-rings 90 and a return spring 92. Air pressure on line 167 forces the piston 86 to retract pin 171 into housing 82. When the piston 86 reaches the end cap 84, air pressure on line 170 is communicated through the piston cavity 87 to line 169. Air in cylinder 80 is vented through exhaust port 94.

The pneumatically controlled pin 171 prevents the guard bar arm 70 (and 51, see FIGS. 2 and 3) and thus the guard bar 50 from pivoting downwardly to allow access to the handles 46 and caps 48 of valves 30 unless the operator activates the unloading function of the monitoring and control system. Accordingly the API valves 30 cannot be opened to unload fuel absent operator control. The operator manually engages the loading valve 115, in order to apply air pressure from source 170 to the guard bar lock cylinder 165, in order to retract the pneumatically controlled pin 171 from the guard bar arm 51, thus allowing the arm to move downward, after release of the spring catch 53, exposing the API valves 30 for loading. Only when the guard bar lock cylinder 165 moves the pneumatically controlled pin 171 fully to its retracted position does it pneumatically activate the guard bar lock valve 172 to send an air signal to shuttle valve 173 via line 169, whereby this air signal is then communicated to line 164. Air pressure on line 164 is communicated to shuttle valve 166 and then to line 168 to lock the truck's parking brakes.

Air on line 164 also travels through shuttle valves 120 to activate all of the vent valve actuators 122 and drain valve actuators 124 to open vent valves 34 and drain valves 36. The unique shape and design of guard bar arm 51, prevents access to the pneumatically controlled pin 171 when the guard bar 50 is raised and locked, blocking any attempts at manual tampering to forcibly lower the bar. When the guard bar is lowered, the unique shape of the guard bar arm 51 mechanically blocks the pneumatically controlled pin 171 from extending even on loss of the air signal on line 167, thereby requiring the guard bar to be raised and locked before the truck's brakes can be released.

Referring to FIGS. 9*a* and 9*b*, a pneumatic control for the manifold system is generally indicated by reference numerals 100*a* and 100*b*. The pneumatic control system 100*a* and 100*b* includes a logic controller 102, product grade indicators 104, manifold control valve actuators 106 and 108, compartment control valve actuators 110*a-e*, cylinder control valve actuators 112*a-e*, manifold cylinder valve actuators 114*a-e* and 116*a-e*, a product return roller valve 118, product return shuttle valves 120*a-e*, compartment vent valve actuators 122*a-e* and compartment emergency valve actuators 124*a-e*.

The logic controller 102 is a microprocessor based controller which monitors and controls pneumatic and electrical inputs and outputs. The logic controller includes status lights 126 to provide information to the operator regarding the status of the pneumatic system 100. Logic controller 102 also includes control switches 128 which operate the valves to selectively control delivery of fuel through a selected port on the manifold.

For example, FIGS. 9*a* and 9*b* include actuators and valves configured for a five-compartment tank 24. For purposes of this example it may be assumed that the first compartment 28*a* contains unleaded gasoline, the second compartment 28*b* contains unleaded plus gasoline, the third compartment 28*c* contains super unleaded gasoline, the fourth compartment 28*d* contains clear diesel, and the fifth compartment 28*e* contains dyed diesel. When the compartments 28*a-e* of tank 24 are filled with their respective product, the product grade indicators (PGI) 104*a-e* are set accordingly by an operator. For example, PGI 104*a* is set to unleaded gasoline, PGI 104*b* is set to unleaded plus gasoline, PGI 104*c* is set to super or premium unleaded gasoline, PGI 104*d* is set to clear diesel and PGI 104*e* is set to dyed diesel. The PGIs 104 are typically physically located above the corresponding ports on the frame of the truck (see FIG. 10).

Each PGI 104 includes an encoder output on lines 130 which indicates the position of the PGI 104 and thus enables the controller 102 to identify the content of each compartment 28 of tank 24. PGI 104 may have eight or more unique positions to uniquely identify eight or more products. The PGI 104 is discussed in more detail herein below.

Referring to FIGS. 9*a*, 9*b*, 10 and 11, and continuing with the present example, a fluid flow diagram is illustrated in FIGS. 10 and 11 and generally indicated by reference numeral 200. Fluid flow diagram 200 corresponds to the pneumatic diagrams 100*a* and 100*b* shown in FIGS. 9*a* and 9*b*. In the initial state, all valves are closed and the actuators are as shown in FIGS. 9*a* and 9*b*.

If an operator is delivering unleaded gasoline from compartment 28*a*, for example, the operator starts the gasoline pump 202 which outputs a pneumatic signal 132 on line 134 to controller 102. Controller 102 activates the gasoline manifold control valve actuator 106 on line 136. Air pressure from the source 170 which was directed to line 107 holding all of the gasoline manifold cylinder actuators 114 closed is vented. Air pressure from source 170 is then communicated on line 140 through gasoline manifold control valve actuator 106 to line 142. Air pressure on line 142 shifts the cylinder control valve actuators 112 to the gasoline position indicated by the lower control blocks. Air pressure on line 142 from source 170 is also directed to shuttle valve 146, which directs it to each control valve actuator 110 via line 113. Line 113 also directs air to the reset port of loading valve 115 causing it to be forcefully held closed by air pressure and preventing it from being moved to the loading position by the operator while the truck is involved in a fuel delivery operation. Air pressure in line 142 is also directed to shuttle valve 166 causing air pressure to be directed to line 168 setting the truck's parking brakes.

When the first control button 128 is pressed, the controller 102 activates the compartment-1 control valve actuator 110*a* on line 144*a* which shifts the actuator 110*a* to the left control block. Air pressure on line 142 is transferred through shuttle valve 146 to line 113 through compartment-1 control valve actuator 110*a* to line 148*a*. The air pressure on line 148*a* is communicated through the cylinder control valve actuator 112*a* to line 150*a* to activate manifold cylinder valve actuator 114*a*.

At the same time, air pressure on line 148*a* is communicated to shuttle valve 120*a* to line 152*a* to actuate compartment 28*a* vent valve actuator 122*a* and drain/emergency valve actuator 124*a*.

Valve or nozzle 204 may now be actuated by the operator to deliver unleaded gasoline from compartment 28*a* to a storage tank underground at a gas station (not shown), for example. The vent valve 34*a* is opened by vent valve actuator 122*a* to allow air to enter the compartment 28*a* as the unleaded gasoline is delivered. Drain valve 36*a* is opened by drain valve actuator 124*a*. Unleaded gasoline from compartment 28*a* flows through drain valve 36*a* through pipe 206*a* to manifold port 61*a*. The unleaded gasoline may now flow through cylinder 64*a* which was opened by cylinder valve actuator 114*a* to collector 68 through line 207 to pump 202 and nozzle 204 for delivery.

When the storage tank (not shown) is full or the predetermined amount of fuel has been delivered, the operator closes valve or nozzle 204 then presses the master off button 129 which deactivates the compartment-1 control valve actuator 110*a* by releasing air pressure on line 144*a* which returns to the static position by a return spring. Air pressure on lines 148*a* and 150*a* is vented to allow manifold cylinder actuator 114*a* to return to the static position and close manifold cylinder 64*a*.

Any remaining unwanted fuel in the collector 68 and line 207 leading to pump 202 and in the delivery hose leading to valve or nozzle 204 may be returned to compartment 28*a* by pivoting the return bar 54 upwardly (see FIGS. 2 and 4). The return bar 54 actuates the product return roller valve 118 which shifts to the left control block. Air pressure from source 170 is communicated on line 140 through product return roller valve 118 to line 160. The air is transferred through shuttle valve 162 to line 164 which activates the parking brakes through shuttle valve 173 on line 164 and shuttle valve 166 on line 168 to set the truck's parking brake. Air on line 164 also travels through shuttle valves 120*a-e* to activate all of the vent valve actuators 122*a-e* and drain valve actuators 124*a-e* to open vent valves 34*a-e* and drain valves 36*a-e*. The product return roller valve 118 also provides an air signal to the truck's metering system (not shown) to indicate that the return bar 54 has been raised. This air signal causes the metering system to end the delivery by shutting off the product flow immediately, or to cause the ticket printer to not print a delivery ticket for that delivery to prevent a fraudulent delivery by the driver by pumping the product through the metering system back into the tank via the return spout and still billing the customer for the product that was returned back into the tank.

The operator removes the return spout cap 56*a*, places the nozzle 204 into the return spout 52*a* and pumps the fuel under pressure through the return spout check valve 58*a* into port 61*a* back through drain valve 36*a* into compartment 28*a*. When all of the fuel has been pumped from the collector 68 and line 207, the return spout cap 56*a* is replaced on the return spout 52*a* and the return bar 54 is pivoted back into the closed position (see FIGS. 2 and 4). The product return roller valve 118 returns to the static position and the air pressure on lines 160, 164 and 168 is vented to allow the actuators to return to their static positions and the corresponding valves to close as well as allowing the truck's parking brakes to be released.

If the operator is next delivering unleaded plus gasoline from compartment 28*b*, the operator presses the second control button 128. In response, the controller 102 first checks the output on line 130*b* from PGI 104*b* to determine if a compatible fuel is in compartment 28*b*. Because compartment 28*b* contains unleaded plus gasoline, which is compatible with unleaded gasoline, controller 102 activates compartment-2 control valve actuator 110*b* on line 144*b*, which shifts the actuator 110*b* to the left control block. Air pressure on line 142 is transferred through shuttle valve 146 to line 113 through compartment-2 control valve actuator 110*b* to line 148*b*. The air pressure on line 148*b* is communicated through the cylinder control valve actuator 112*b* to line 150*b* to actuate manifold cylinder valve actuator 114*b*.

At the same time, air pressure on line 148*b* is communicated through shuttle valve 120*b* to line 152*b* to actuate compartment 28*b* vent valve actuator 122*b* and drain/emergency valve actuator 124*b*.

Valve or nozzle 204 may now be actuated by the operator to deliver unleaded plus gasoline from compartment 28*b* to another storage tank (not shown), for example. The vent valve 34*b* is opened by actuator 122*b* to allow air to enter the compartment 28*b* as the unleaded plus gasoline is delivered. Drain valve 36*b* is opened by drain valve actuator 124*b*. Unleaded plus gasoline from compartment 28*b* flows through drain valve 36*b* through pipe 206*b* to manifold port 61*b*. The unleaded plus gasoline may now flow through cylinder 64*b*, which was opened by cylinder valve actuator 114*b*, to collector 68 through line 207 to pump 202 and nozzle 204 for delivery.

When the unleaded plus gasoline storage tank (not shown) is full or the predetermined amount of fuel has been delivered, the operator presses the master off button 129 which deactivates the compartment-2 control valve actuator 110*b* by releasing air pressure on line 144*b*. The compartment-2 control valve actuator 110*b* returns to the static position by a return spring. Air pressure on lines 148*b* and 150*b* is vented to allow manifold cylinder actuator 114*b* to return to the static position and close manifold cylinder 64*b*.

Any remaining unwanted fuel in the manifold 68 and line 207 leading to pump 202 and in the delivery hose leading to valve or nozzle 204 may be returned to compartment 28*b* by pivoting the return bar 54 (see FIGS. 2 and 4) upwardly. The return bar 54 actuates the product return roller valve 118 as described hereinabove. The operator removes the return spout cap 56*b*, places the nozzle into the return spout 52*b* and pumps the fuel under pressure through the return spout check valve 58*b* into port 61*b*, back through drain valve 36*b* into compartment 28*b*. When all of the fuel has been pumped from the collector 68 and line 207, the return spout cap 56*b* is replaced on the return spout 52*b* and the return bar 54 is pivoted back to the closed position. The product return roller 118 returns to the closed position and the air pressure in lines 160, 164 and 168 is vented to allow the actuators to return to their static positions and the associated valves to close as well as allowing the truck's parking brakes to be released.

If the operator is delivering super unleaded gasoline from compartment 28*c*, the operator presses the third control button 128. In response, the controller 102 first checks the output on line 130*c* from PGI 104*c* to determine if a compatible fuel is in compartment 28*b*. Because compartment 28*c* contains super unleaded gasoline, which is compatible with unleaded plus gasoline, controller 102 activates compartment-3 control valve actuator 110*c* on line 144*c*, which shifts the actuator 110*c* to the left control block. Air pressure on line 142 is transferred through shuttle valve 146 to line 113 through compartment-3 control valve actuator 110*c* to line 148*c*. The air pressure on line 148*c* is communicated through the cylinder control valve actuator 112*c* to line 150*c* to actuate manifold cylinder valve actuator 114*c*.

At the same time, air pressure on line 148*c* is communicated through shuttle valve 120*c* to line 152*c* to actuate compartment 28*c* vent valve actuator 122*c* and drain/emergency valve actuator 124*c*.

Valve or nozzle 204 may now be actuated by the operator to deliver super unleaded gasoline from compartment 28*c* to another storage tank (not shown), for example. The vent valve 34*c* is opened by actuator 122*c* to allow air to enter the compartment 28*c* as the unleaded plus gasoline is delivered. Drain valve 36*c* is opened by drain valve actuator 124*c*. Unleaded plus gasoline from compartment 28*c* flows through drain valve 36*c* through pipe 206*c* to manifold port 61*c*. The unleaded plus gasoline may now flow through cylinder 64*c*, which was opened by cylinder valve actuator 114*c*, to collector 68 through line 207 to pump 202 and nozzle 204 for delivery.

When the unleaded plus gasoline storage tank (not shown) is full or the predetermined amount of fuel has been delivered, the operator presses the master off button 129 which deactivates the compartment-3 control valve actuator 110*c* by releasing air pressure on line 144*c*. The compartment-3 control valve actuator 110*c* returns to the static position by a return spring. Air pressure on lines 148*c* and 150*c* is vented to allow manifold cylinder actuator 114*c* to return to the static position and close manifold cylinder 64*c*.

Any remaining unwanted fuel in the manifold 68 and line 207 leading to pump 202 and in the delivery hose leading to valve or nozzle 204 may be returned to compartment 28*c* by pivoting the return bar 54 (see FIGS. 2 and 4) upwardly. The return bar 54 actuates the product return roller valve 118, and the fuel may be returned to compartment 28*c* as described hereinabove.

If the operator is next delivering clear diesel fuel from compartment 28*d*, for example, the operator first stops the gasoline pump 202, thereby removing the pneumatic signal 132 on line 134. This causes the controller 102 to deactivate the gasoline manifold control valve actuator 106 on line 136. This causes air pressure from the source 170 to be applied to line 107 and to all of the gasoline manifold cylinder actuators 114, thereby forcibly holding all of them closed pneumatically as well as by spring force.

The operator then starts the diesel pump 203, which outputs a pneumatic signal 133 on line 135 to controller 102. Controller 102 activates the diesel manifold control valve actuator 108 on line 138. Air pressure from the source 170 which was directed to line 109 holding all of the diesel manifold cylinder actuators 114 closed is vented. Air pressure from source 170 is then communicated on line 140 through diesel manifold control valve actuator 108 to line 143. Air pressure on line 143 shifts the cylinder control valve actuators 112 to the diesel position indicated by the upper control blocks. Air pressure in line 142 from source 170 is also directed to shuttle valve 146, which directs it to each control valve actuator 110 via line 113. Line 113 also directs air to the reset port of loading valve 115 causing it to be forcefully held closed by air pressure to prevent it from being moved to the loading position by the operator while the truck is involved in a fuel delivery operation. Air pressure in line 142 is also directed to shuttle valve 166 causing air pressure to be directed to line 168 setting the truck's parking brakes.

If the operator attempts to deliver diesel fuel from either compartment 28*d* or 28*e* by pressing either the fourth or fifth control button 128 when the gasoline pump 202 is activated, the controller 102 determines from the PGI indicators 104 that these products are not compatible. The controller 102 provides an audible and visible error indication to the operator and will not allow control valve actuators 110*d* or 110*e* to activate, thus keeping all actuators and all valves in their static position until the operator realizes the error and disengages the gasoline pump 202 and engages the diesel pump 203.

If the gasoline pump 202 is not running and the diesel pump 203 is running when the operator presses the fourth control button 128, controller 102 activates compartment-4 control valve actuator 110*d* on line 144*d*, which shifts the actuator 110*d* to the left control block. Air pressure on line 143 is transferred through shuttle valve 146 to line 113 through compartment-4 control valve actuator 110*d* to line 148*d*. The air pressure on line 148*d* is communicated through the cylinder control valve actuator 112*d* to line 151*d* to actuate manifold cylinder valve actuator 116*d*.

At the same time, air pressure on line 148*d* is communicated through shuttle valve 120*d* to line 152*d* to actuate compartment 28*d* vent valve actuator 122*d* and drain/emergency valve actuator 124*d*.

Valve or nozzle 205 may now be actuated by the operator to deliver clear diesel fuel from compartment 28*d* to another storage tank (not shown), for example. The vent valve 34*d* is opened by actuator 122*d* to allow air to enter the compartment 28*d* as the clear diesel fuel is delivered. Drain valve 36*d* is opened by drain valve actuator 124*d*. Clear diesel fuel from compartment 28*d* flows through drain valve 36*d* through pipe 206*d* to manifold port 61*d*. The clear diesel fuel may now flow through cylinder 62*d*, which was opened by cylinder valve actuator 116*d*, to collector 66 through line 209 to pump 203 and nozzle 205 for delivery.

When the clear diesel fuel storage tank (not shown) is full or the predetermined amount of fuel has been delivered, the operator closes valve or nozzle 205 then presses the master off button 129 which deactivates the compartment-4 control valve actuator 110*d* by releasing air pressure on line 144*d*. The compartment-4 control valve actuator 110*d* returns to the static position by a return spring. Air pressure on lines 148*d* and 151*d* is vented to allow manifold cylinder actuator 116*d* to return to the static position and close manifold cylinder 62*d*.

Any remaining unwanted fuel in the manifold 66 and line 209 leading to pump 203 and in the delivery hose leading to valve or nozzle 205 may be returned to compartment 28*d* by pivoting the return bar 54 upwardly (see FIGS. 2 and 4). The return bar 54 actuates the product return roller valve 118 and the fuel may be returned to compartment 28*d* as described hereinabove.

If the operator is delivering dyed diesel fuel from compartment 28*e*, the operator presses the fifth control button 128. In response, the controller 102 first checks the output on line 130*e* from PGI 104*e* to determine if a compatible fuel is in compartment 28*e*. Because compartment 28*e* contains dyed diesel fuel, which is compatible with clear diesel fuel but is a different type of compatible fuel, the controller 102 will not activate compartment-5 control valve actuator 110*e* until the operator dispenses enough fuel from compartment 28*d* which is remaining in the collector 66 through pump 203 and valve or nozzle 205 for the collector 66 to empty and the diesel retained product sensor 139 to become dry. Controller 102 constantly monitors the retained product sensor 139 by checking the input on line 137.

Once the retained product sensor 139 becomes dry, the controller 102 automatically activates compartment-5 control valve actuator 110*e* on line 144*e*, which shifts the actuator 110*e* to the left control block. Air pressure on line 142 is transferred through shuttle valve 146 to line 113 through compartment-5 control valve actuator 110*e* to line 148*e*. The air pressure on line 148*e* is communicated through the cylinder control valve actuator 112*e* to line 151*e* to actuate manifold cylinder valve actuator 1116*e*.

At the same time, air pressure on line 148*e* is communicated through shuttle valve 120*e* to line 152*e* to actuate compartment 28*e* vent valve actuator 122*e* and drain/emergency valve actuator 124*e*.

Valve or nozzle 205 may now be actuated by the operator to deliver dyed diesel fuel from compartment 28*e* to another storage tank (not shown), for example. The vent valve 34*e* is opened by actuator 122*e* to allow air to enter the compartment 28*e* as the dyed diesel fuel is delivered. Drain valve 36*e* is opened by drain valve actuator 124*e*. Dyed diesel fuel from compartment 28*e* flows through drain valve 36*e* through pipe 206*e* to manifold port 61*e*. The dyed diesel fuel may now flow through cylinder 62*e*, which was opened by cylinder valve actuator 116*e*, to collector 66 through line 209 to pump 203 and nozzle 205 for delivery.

When the dyed diesel fuel storage tank (not shown) is full or the predetermined amount of fuel has been delivered, the operator closes valve or nozzle 205 then presses the master off button 129 which deactivates the compartments control valve actuator 110*e* by releasing air pressure on line 144*e*. The compartment-5 control valve actuator 110*e* returns to the static position by a return spring. Air pressure on lines 148*e* and 150*e* is vented to allow manifold cylinder actuator 114*e* to return to the static position and close manifold cylinder 62*e*.

Any remaining unwanted fuel in the manifold 66 and line leading to pump 203 and in the delivery hose leading to valve or nozzle 205 may be returned to compartment 28*e* by pivoting the return bar 54 (see FIGS. 2 and 4) upwardly. The return bar 54 actuates the product return roller valve 118 as described hereinabove.

Figure 13:
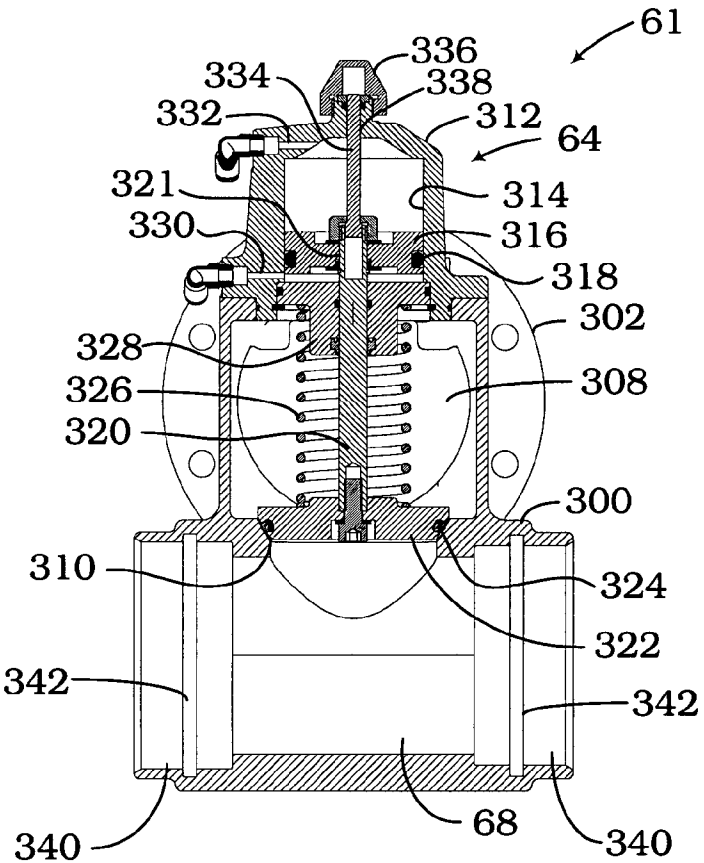
FIG. 13 is an enlarged sectional view taken along line 13-13 of FIG. 12 showing one cylinder and port structure.

Referring to FIGS. 12 and 13, manifold port 61 includes a body 300, rear flange 302 to secure the manifold to the frame 25 of a truck 20 (see FIG. 1), a pair of cylinders 62 and 64, a front flange 304 to secure an API valve to the front of the manifold port 61, and a return spout flange 306 to secure the return spout 52 to the manifold port 61. Manifold port 61 is generally hollow with a passage 308 which extends through the manifold port 61 from the front flange 304 to the rear flange 302. Manifold port 61 also has an aperture 310 which is axially aligned with the longitudinal axis of the cylinder 64 and connects the passage 308 to the collector 68. Passage 308 runs generally perpendicular to the collectors 66 and 68 in a plane above the collectors 66 and 68. Another aperture (not shown) connects the passage 308 to collector 66 and is in axial alignment with the longitudinal axis of cylinder 62.

Cylinder 64 includes a housing 312 with a bore 314 for a piston 316. The space between bore 314 and piston 316 is sealed with an O-ring 318. Piston 316 is secured to a valve stem 320 with one end and a valve poppet 322 is secured to the opposite end of the valve stem. Valve poppet 322 is generally circular in shape with angled side walls which seat in the aperture 310 between the passage 308 and collector 68. An O-ring 324 seals the valve poppet 322 in the aperture 310. A spring 326 presses against the cylinder end plate 328 and the valve poppet 322 to hold the valve in the normally closed position. An air pressure inlet port 330 allows air pressure to move the piston 316 upwardly in the bore 314 away from the cylinder end plate 328 to open the cylinder 64. An exhaust vent port 332 at the top of the cylinder 64 allows air in the bore 314 to escape and enter.

An indicator rod 334 is secured to the end 321 of the stem 320 and extends upwardly along the longitudinal axis of the bore 314. A clear or opaque indicator cover or sight glass 336 is secured to the top of the cylinder 64. When the cylinder 64 is opened to allow fuel in the port passage 308 to enter the collector 68 through aperture 310, the end of the indicator rod 334 extends upwardly through an aperture 338 in the top of the cylinder and into the indicator cover 336. The indicator rod 334 may be red or another contrasting color so that an operator may readily determine which cylinder is open by looking at the sight glasses 336. The end 321 of stem 320 includes a lost motion arrangement whereby excess travel of the valve stem 320 driving the indicator rod 334 upward into the sight glass 336 is lost once the indicator rod 334 contacts the top of the sight glass 336. As such, this additional travel of the valve stem 320 does not push the indicator rod 334 through the sight glass and no adjustments for excess travel are needed. The indicator rod 334 is visible just after the valve's initial movement, not just at full stroke open.

When air pressure is removed from inlet port 330, the spring 326 forces the cylinder 64 to close. Air is drawn into the cylinder bore 314 through exhaust vent port 332 and out of cylinder bore 312 through inlet port 330. Collector 68 includes an opening at each end 340 which is adapted to receive a connecting pipe (see FIG. 11), which forms the collector between ports, or to receive a plug to seal the end of the collector 68. The connecting pipe or plug is sealed by an O-ring 342. For standard installations, the connecting pipe may be cast with flanges at one or both ends (not shown) which are then bolted to the manifold port 61.

Figure 15:
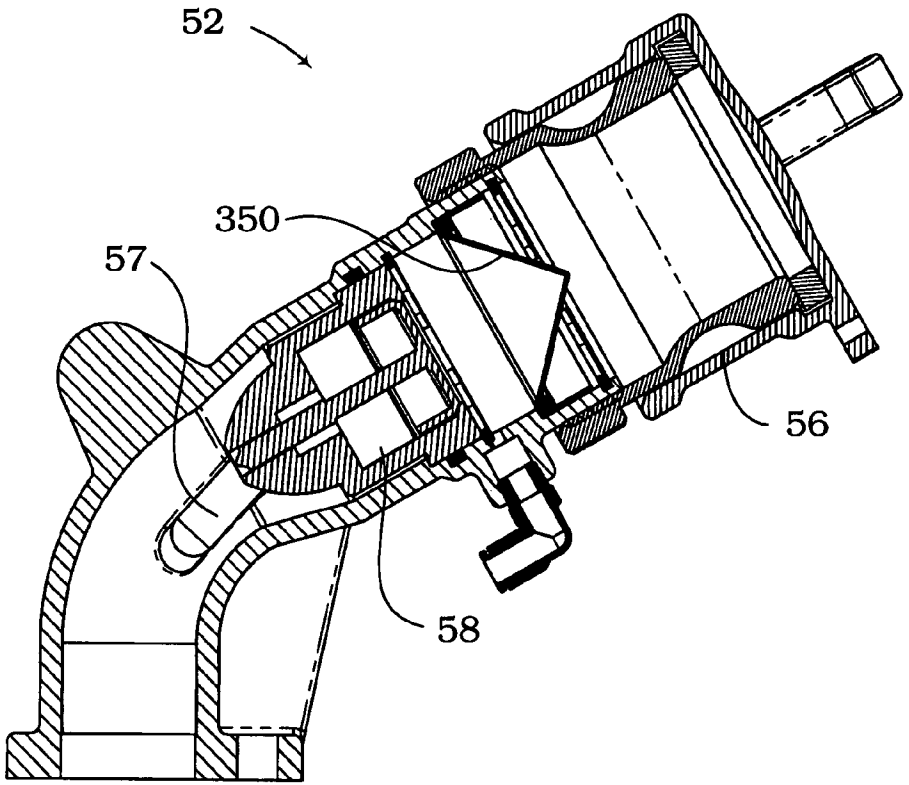
FIG. 15 is a longitudinal sectional view taken along line 15-15 of FIG. 14.
Figure 14:
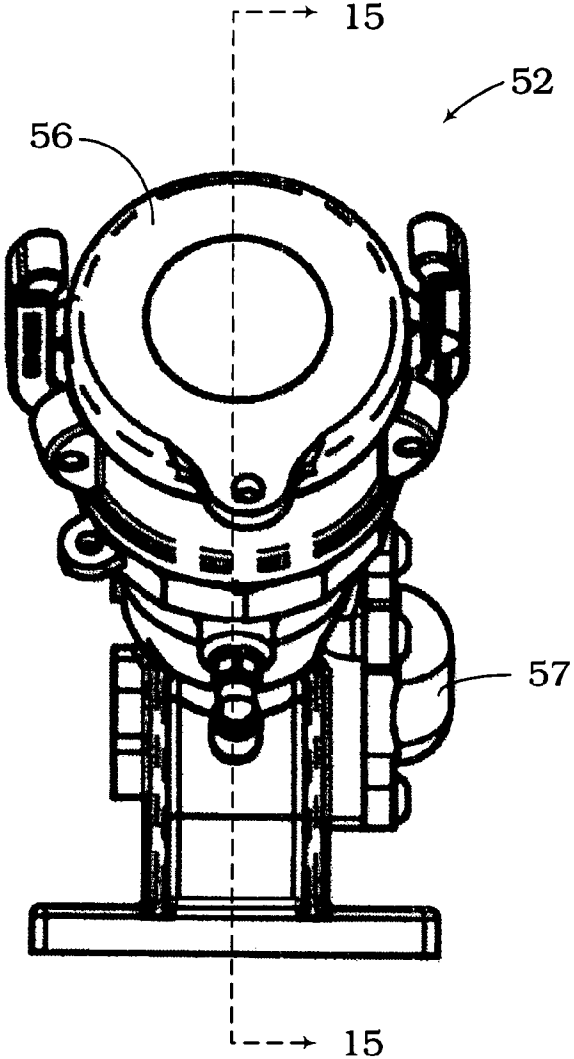
FIG. 14 is a perspective view of a return spout.
Figure 16:
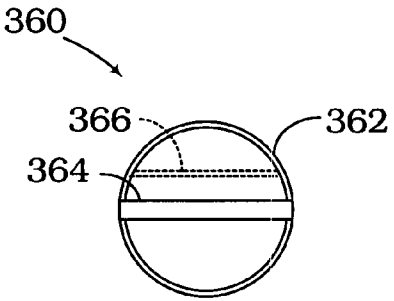
FIG. 16 is an end view of a collector drain plug.
Figure 17:
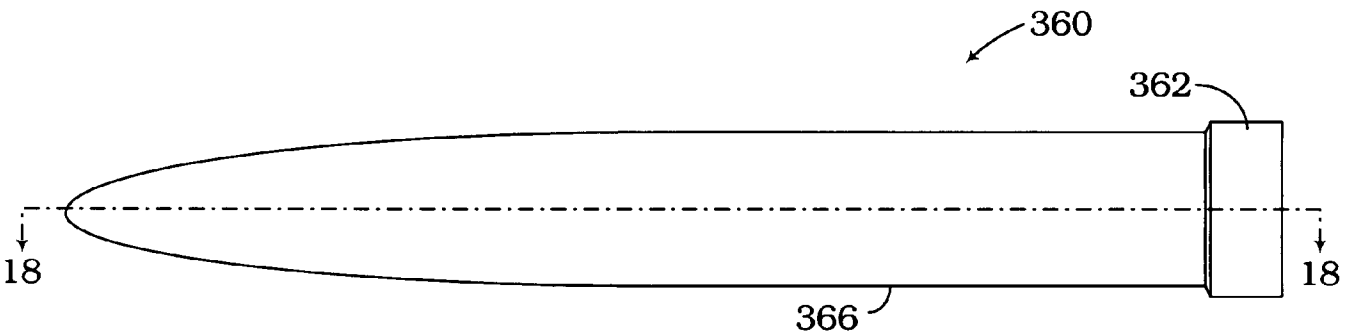
FIG. 17 is a top plan view of the collector drain plug of FIG. 16.
Figure 18:
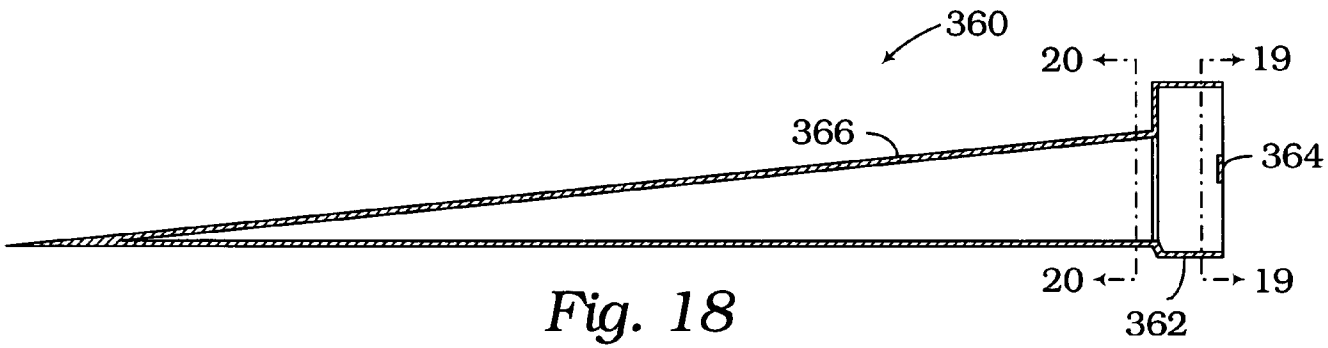
FIG. 18 is a longitudinal sectional view of the collector drain plug taken along line 18-18 of FIG. 17.
Figure 20:
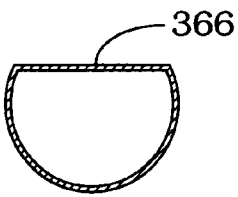
FIG. 20 is a sectional view of the collector drain plug taken along line 20-20 of FIG. 18.
Figure 19:
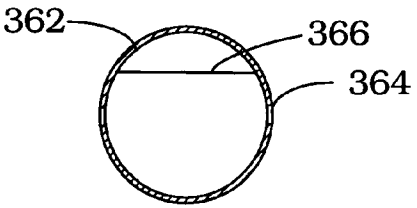
FIG. 19 is a sectional view of the collector drain plug taken along line 19-19 of FIG. 18.

Referring to FIGS. 14 and 15, return spout 52 includes a cap 56, a strainer 350, a check valve 58 and a sight glass 57. Return spout 52 bolts to the return spout flange 306 of manifold 62 to provide a return path for fuel as described hereinabove.

Referring to FIGS. 16-20, a collector drain plug wedge is generally indicated by reference numeral 360. Collector drain plug wedge 360 may be inserted into the end of a collector when the delivery vehicle is parked on an incline so that the fuel will not be retained in the collector. Collector drain plug wedge 360 includes an end plug 362 adapted to securely fit into collector opening 340 and sealed by O-ring 342 (see FIG. 13), a handle 364 and a wedge-shaped extension 366 of plug 362 to provide a sloped surface within a collector.

Figure 22:
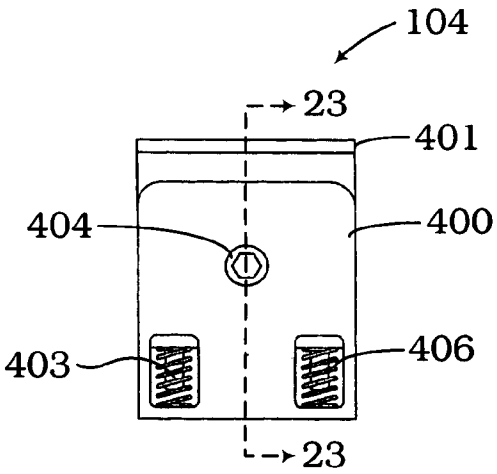
FIG. 22 is a left side elevational view of the product grade indicator of FIG. 21.
Figure 21:
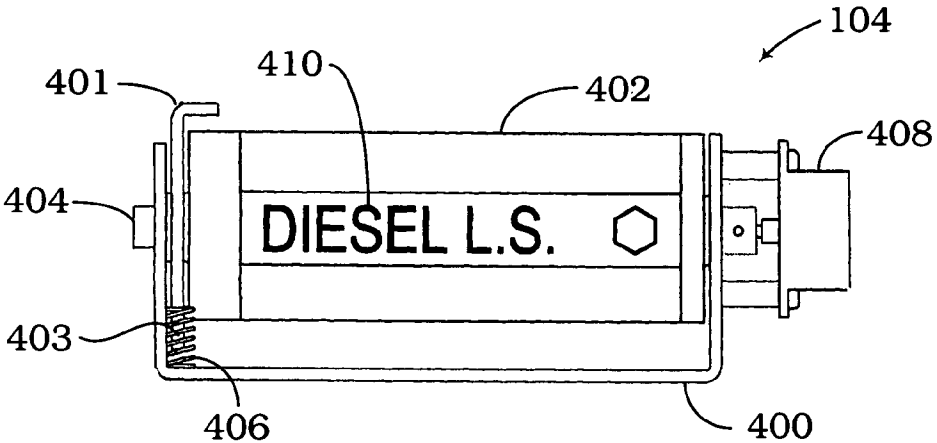
FIG. 21 is a front elevational view of a product grade indicator.
Figure 23:
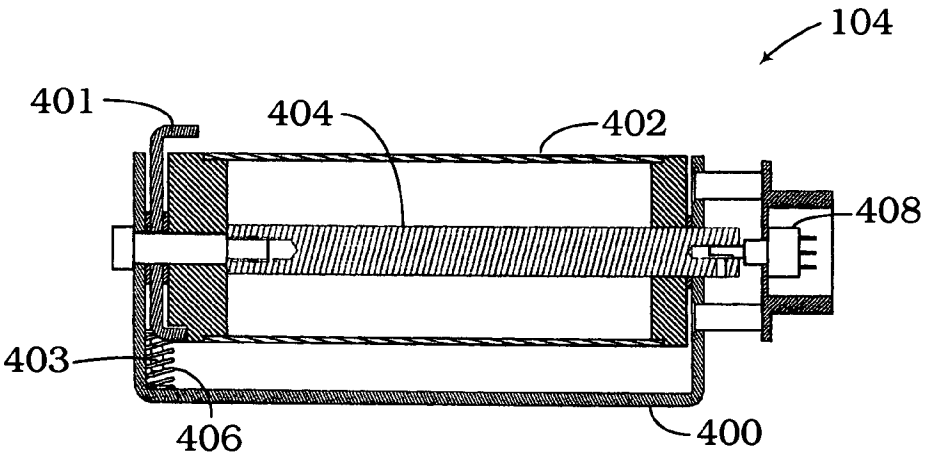
FIG. 23 is a sectional view of the product grade indicator taken along line 23-23 of FIG. 22.

Referring to FIGS. 21-23, product grade indicator 104 includes a mounting bracket/frame 400, a latching plate 401, and a product indicator cylinder 402 mounted on a shaft 404. A pair of compression springs 406 surrounding depending guide pins 403 hold the latching plate 401 in a latched position as illustrated, keeping the latching plate 401 engaged in the product indicator cylinder 402 to prevent the cylinder from inadvertently rotating about shaft 404. An encoder 408, mounted to the mounting bracket/frame 400 is secured to an end of shaft 404 and provides position information to the controller 102 on line 130 (see FIGS. 9*a* and 9*b*). Visual indication 410 on the surface of the product indicator cylinder 402 is used by the operator to identify the contents of a corresponding compartment. The operator depresses the latching plate 401 against the compression springs 406 to release the product indicator cylinder 402. The operator then rotates the product indicator cylinder 402 to the corresponding product. The encoder 408 uniquely identifies the product for use by the controller 102. The product grade indicator 104 may include a multi-sided (octagonal, etc) cylinder 402 or a round cylinder for example.

Figure 24:
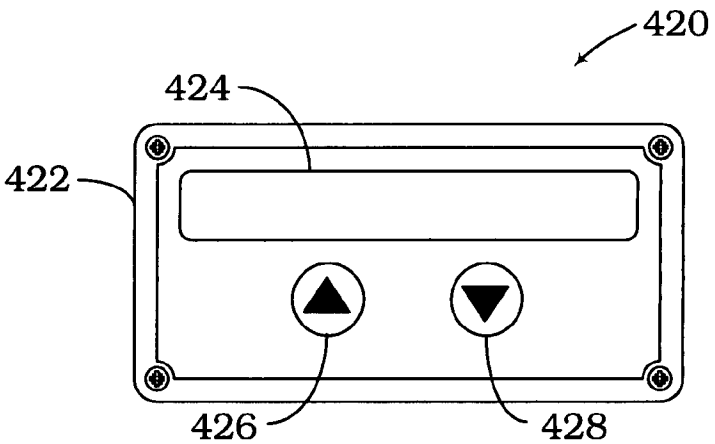
FIG. 24 is a front elevational view of another embodiment of a product grade indicator.

Referring to FIG. 24, another embodiment of a product grade indicator is generally indicated by reference numeral 420. Product grade indicator 420 includes a housing 422, an LCD or LED panel 424 and product selection buttons 426 and 428. A single product selector button may also be used to scroll through the product choices. The panel 424 displays the name of the product loaded in a corresponding compartment of the tank (see FIG. 1). When the product is loaded, the operator uses the up 426 or down 428 section button scroll through the list of products to display the product loaded in the compartment on the panel 424. PGI 420 provides an output to controller 102 on line 130 (see FIGS. 9*a* and 9*b*) which identifies the displayed product.

Referring to FIGS. 1-5, it should now be appreciated that the modular manifold 40 and 60 may be configured with any number of ports corresponding to the compartments of the fuel tank. The manifold ports 41 or 61 are fastened to the truck frame side by side and the lower collectors are formed by short lengths of pipe sections or cast pipe with flanges between adjacent ports. Advantageously, a sight glass in the form of a clear tube replacing the standard aluminum pipe connecting one port to another may be used to give the operator a positive indication of fuel held within the collector. The guard bar 50 and return spout bar 54 may be cut to a length to extend between the outside API valves. In this manner, the manifold ports may be spaced at any desired distance when they are mounted to a vehicle. They may be removed and remounted on another vehicle with a different spacing by utilizing collector pipes, a guard bar and a return spout bar of the appropriate corresponding length.

Figure 25:
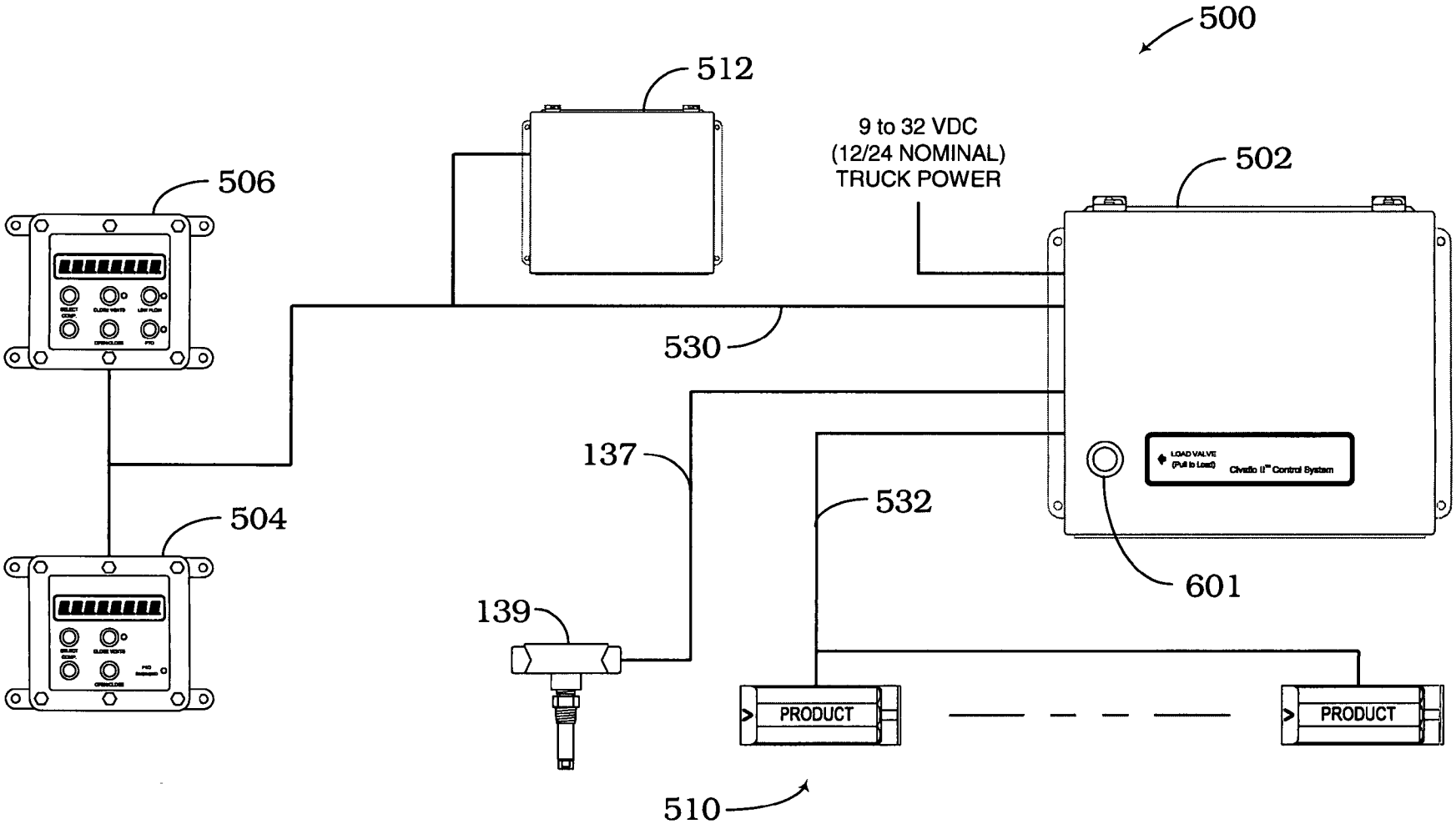
FIG. 25 is a diagrammatic illustration of the control components of another embodiment of the modular manifold system of the present invention.

Referring to FIG. 25, the control components of another embodiment of the modular manifold control system of the present invention are generally indicated by reference numeral 500. Control system 500 includes a main control housing 502, a remote operator interface unit 504, an enhanced remote operator interface unit 506, a retained product sensor 139, one or more product grade indicators 510, and one or more optional auxiliary control housings 512. Generally, the difference between the control system described hereinabove and control system 500 is that the control system 500 is distributed, i.e., employs a main controller 600 (FIG. 30) in main control housing 502 that has no operator controls or display except for the manual load valve 601 which is pulled to activate the air valve to enable loading of the truck with fuel, and the remote operator interface units 504 and 506 mounted to the rear of the truck (see FIG. 1; 506 is hidden from view by 504).

Figure 27:
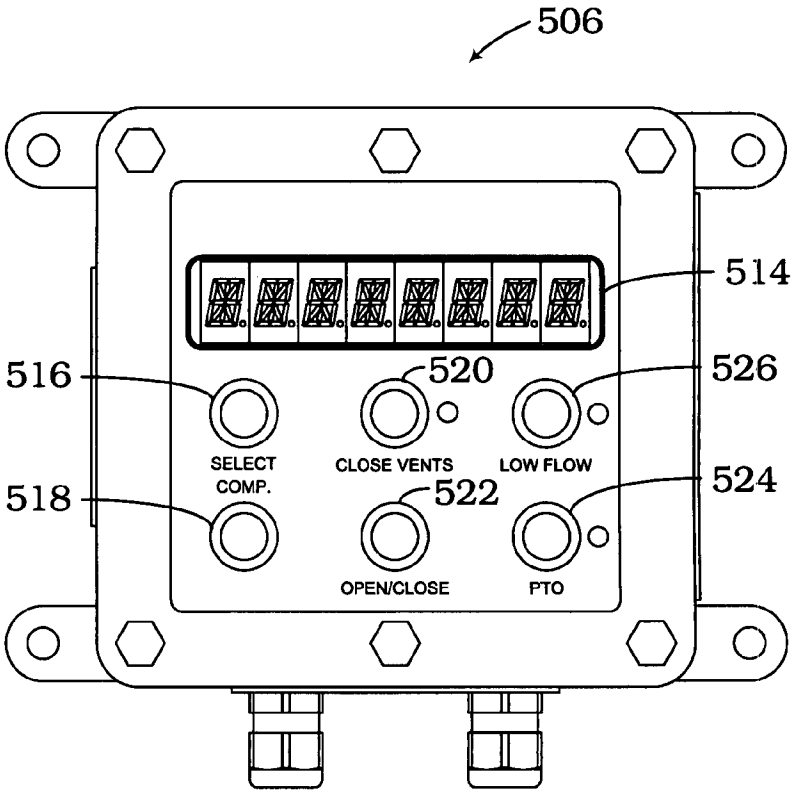
FIG. 27 is an illustration of an enhanced remote operator interface.
Figure 26:
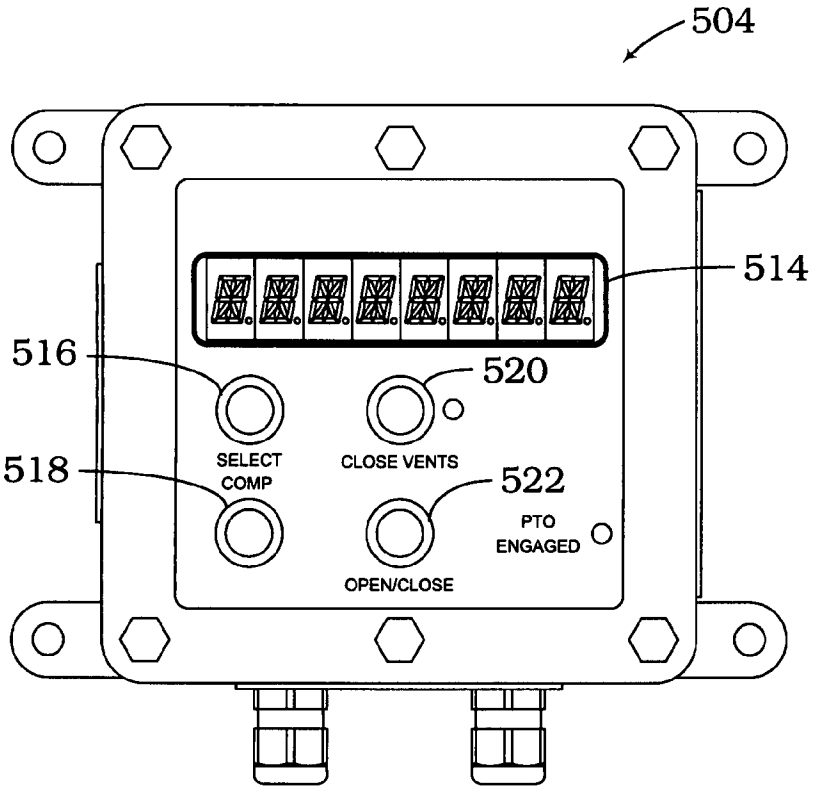
FIG. 26 is an illustration of a remote operator interface.

The operator interface and display of the control system 500 are included on the remote operator interface units 504 and 506 (see FIGS. 26 and 27). Typically, one or two remote operator interface units may be used with the distributed control system 500. Each of the remote operator interface units 504 and 506 includes an eight-character alphanumeric display 514, compartment selection buttons 516 and 518, a vent close button 520, and an open/close button 522. An LCD or other display may also be used. The enhanced remote interface unit 506 also includes a control button 524 for engaging the PTO (power take off) air and a low flow control button 526 for enabling a lower flow rate from the fuel pumps (not shown). The remote operator interface units 504 and 506 connect to the main enclosure 502 via a four-wire cable 530 that provides power and communication. The units 504 and 506 may be connected together by the same cable 530. Communication between the control components of the distributed control system 500 is via half-duplex RS-485 serial communications standard.

The eight-character alphanumeric display 514 displays the PGI setting/product grade as the user pushes the up 516 and down 518 compartment selection buttons to select the compartment/product to dispense. For example, the display may be 1-KEROSN to indicate that kerosene is loaded in compartment 1; 2-EMPTY to indicate that the second compartment is empty; and 3-RG UNL to indicate that regular unleaded is loaded in compartment three, etc. It should be understood that other sized displays may be used.

Figure 28:
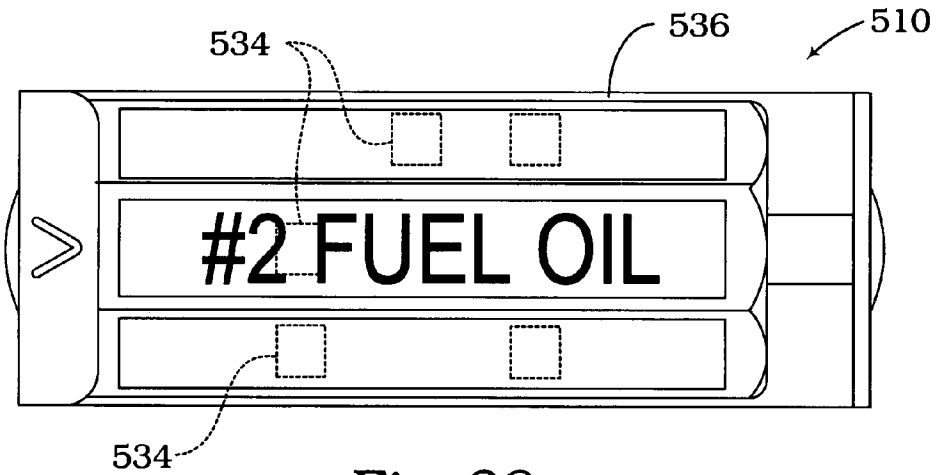
FIG. 28 is a top plan view of another embodiment of a product grade indicator.
Figure 29:
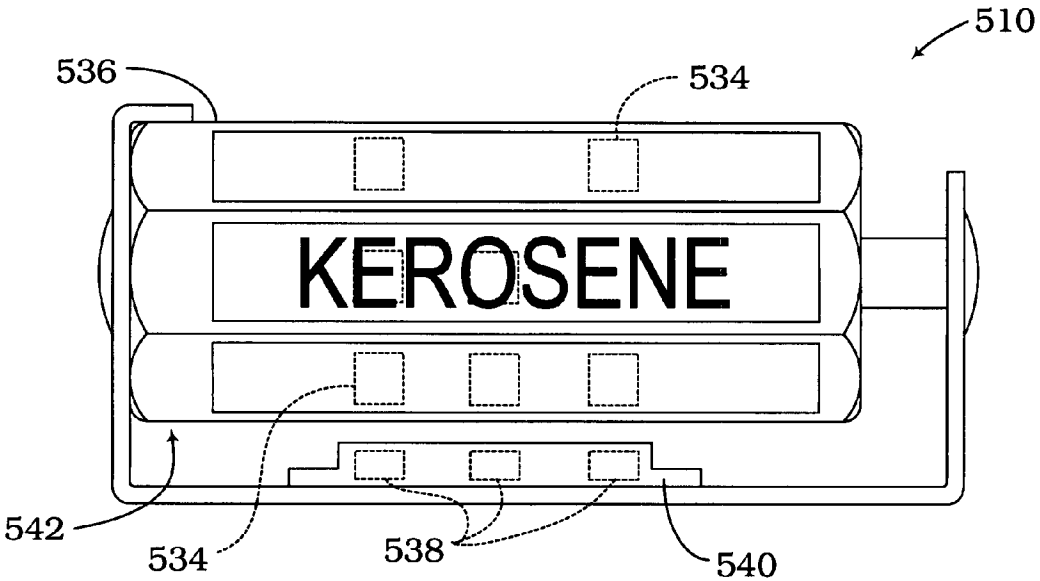
FIG. 29 is a front elevational view of the product grade indicator of FIG. 28.

Referring to FIGS. 28-29, product grade indicators (PGI) 510 are serially connected to the main control unit circuit board assembly 600 (see FIG. 30) via control cable 532 and utilizing half-duplex RS-485 communications standard. During setup the PGIs 510 are self-configuring nodes on the network as the user connects them in order (i.e., compartment 1, 2, 3, 4, 5, etc.). The encoding of each side of the eight-sided PGIs 510 is done by magnets 534 embedded inside the barrel 536 on each side of the octagonal barrel 536, and three magnetically actuated, normally open reed switches 538 mounted in a housing 540 below the barrel 536. As the barrel 536 is rotated, the reed switches 538 open and close depending on the presence or absence of a magnet 534 aligned with each switch 538 in the side 542 proximal the housing 540. Using three switches 538, a combination of eight unique binary numbers may be used to identify the position of the PGIs 510 and consequently the content of the corresponding compartment. The PGIs 510 are mounted to the truck above the API valves as described hereinabove.

Figure 30:
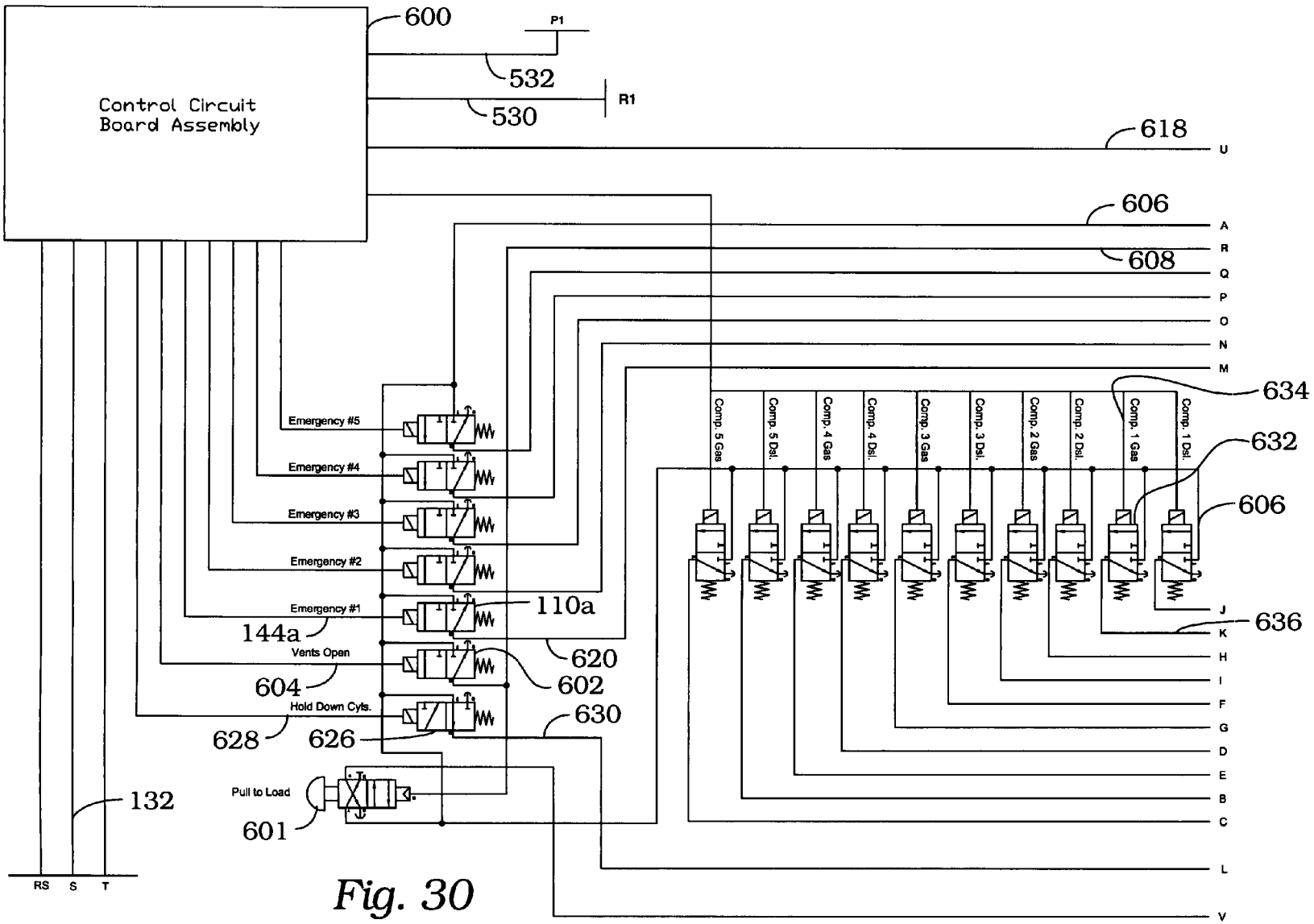
FIG. 30 is a control schematic of the components located inside the main control housing of FIG. 25.
Figure 31:
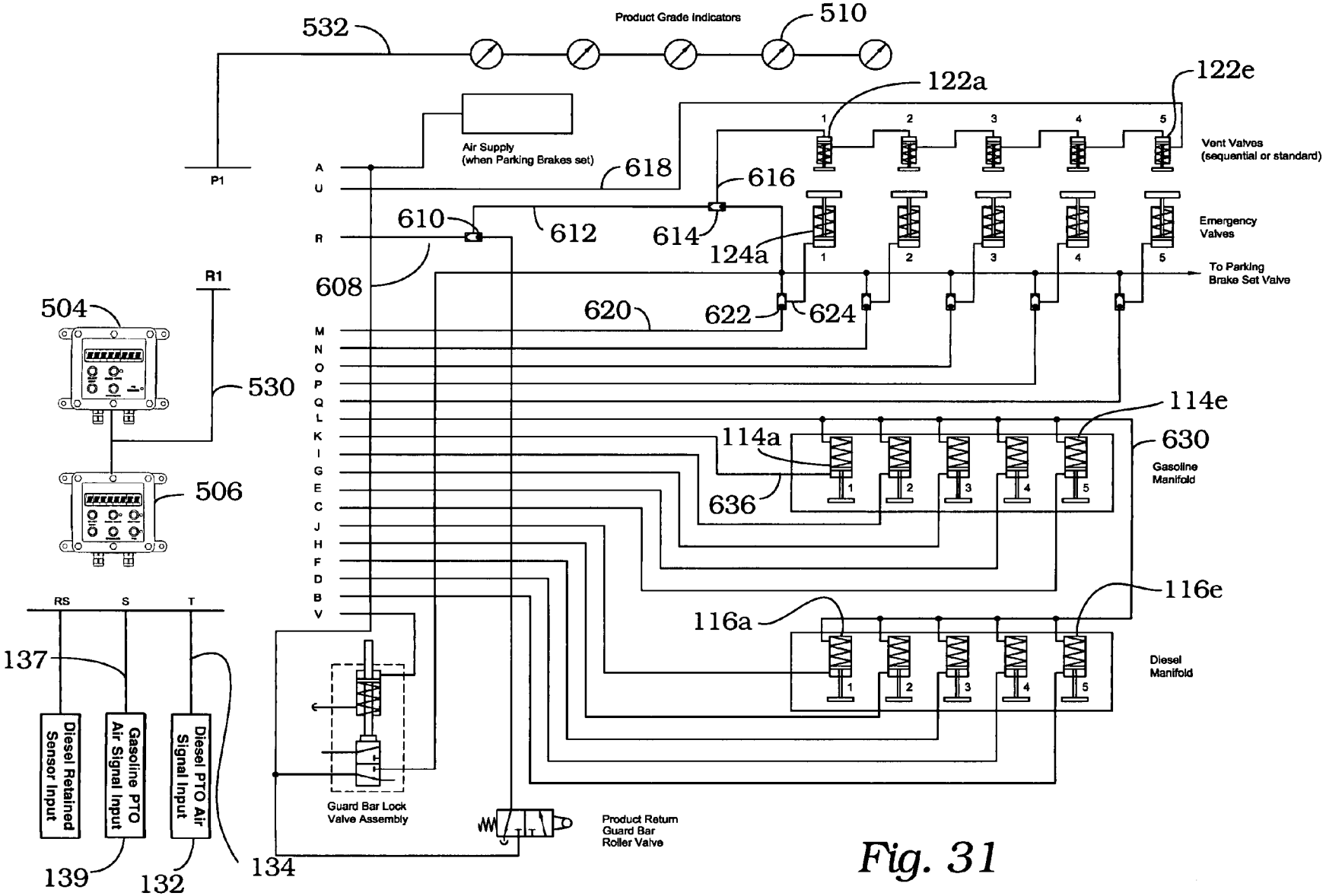
FIG. 31 is a control schematic of the components located outside the main control housing of FIG. 25.

Referring to FIGS. 30 and 31, by way of example, the driver selects the compartment containing the product he wishes to dispense from the truck. If the truck has two reel hoses, one for gasoline products and one for diesel-type products, the system may be configured with two remote operator interface units 504 and 506 (in any combination), one for each of the reel hoses. As the driver presses the up 516 or down 518 compartment select buttons on either of the interface units 504 and 506, only the products corresponding to the appropriate reel hose will be displayed. For example, if the compartment 1 contains unleaded gasoline, compartment 2 contains unleaded plus gasoline, compartment 3 contains super unleaded gasoline, compartment 4 contains clear diesel, and compartment 5 contains dyed diesel, only the gasoline grades in compartments 1-3 will be displayed on the remote operator interface unit configured for the gasoline reel hose and only the diesel products in compartments 4 and 5 will be displayed on the remote operator interface unit configured for the diesel reel hose.

If the driver is delivering gasoline, for example, the driver starts the gasoline fuel pump which inputs a PTO air signal 132 on line 134 to controller 600. For convenience and clarity, the same reference numerals found in FIGS. 9*a* and 9*b* are used in FIGS. 30 and 31 for like components. The driver presses the up 516 or down 518 buttons on the remote operator interface unit 506 (for example) until the compartment which contains the product to be delivered, such as 1-RG UNL, is displayed. The driver then presses the open/close button 522. The control unit checks that the proper PTO is engaged (on line 134 for gasoline). If the driver did not start the gasoline pump before pressing the open/close button 522, the remote operator interface unit 506 may display an error such as ERR GPTO (or ERR DPTO if attempting to dispense diesel without the diesel PTO air signal present).

If the gasoline PTO air signal is present on line 134, the controller 600 activates a vent valve actuator 602 on line 604 which shifts the actuator 602 to the left control block. Air pressure on line 606 is transferred through vent valve actuator 602 to line 608 through shuttle valve 610 to line 612, through shuttle valve 614 to line 616. All of the vents 122*a*-122*e* which are connected serially are opened. The controller 600 waits for a return air signal on line 618 to confirm that all the vents 122*a*-122*e* are open. If a return air signal is not received within 15 seconds (for example) after the controller 600 activates the vent valve actuator 602, an error message such as ERR VENT is displayed on the remote operator interface unit 506. The driver may override the all vents open condition by pressing the close vents button 520 (FIGS. 26 and 27). This allows the driver to keep the vents closed when the truck is full and parked on a hill to prevent product from escaping from the open vents.

If the vents open signal is received on line 618, the controller 600 activates compartment 1 control valve actuator 110*a* on line 144*a* which shifts the actuator 110*a* to the left control block. Air pressure on line 606 is transferred through actuator 110*a* to line 620, through shuttle valve 622 to line 624 to drain valve actuator 124*a* to open the emergency drain valve for compartment 1. The controller 600 activates the hold down cylinders actuator 626 on line 628 which shifts the actuator 626 to the left control block. Air pressure in line 630 is vented releasing the hold down signal on all of the manifold cylinder actuators 114*a*-114*e* and 116*a*-116*e*. The controller 600 activates the compartment 1 gasoline actuator 632 on line 634 which shifts the actuator 632 to the upper control block. Air pressure on line 606 is transferred through actuator 632 to line 636 which activates the compartment 1 gasoline manifold actuator 114*a* and the driver may now begin delivering unleaded gasoline from compartment 1.

After the driver finishes delivering the unleaded gasoline from compartment 1, he pushes the open/close button 522 (FIG. 27). The controller 600 waits 15 seconds, for example, for the next compartment to be opened by the driver scrolling to the next compartment using the up 516 or down 518 buttons and pressing the open/close button 522. If there is no activity on the remote operator interface unit 506 for 15 seconds after closing the manifold valve and emergency drain valve, the vent valves 122*a*-*e* are closed and air pressure is reapplied to the gasoline 114*a*-*e* and diesel 116*a*-*e* actuators to hold the manifold valves closed.

If two compartments contain the identical product, the driver may open the first compartment as described hereinabove, then scroll the display on the remote operator interface unit to the next compartment containing the identical product and open that compartment's emergency drain valve and corresponding manifold valve. The controller 600 ensures that the PGI's 510 are set to the identical setting before opening the associated valves. If the driver has one compartment emergency drain valve and corresponding manifold valve open and then scrolls the display on the remote operator interface unit to a different but compatible product, the system controller 600 closes the valves currently open and opens the valves corresponding to the product displayed on the remote operator interface unit.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is as follows:

1. A manifold for use with a plurality of tank compartments of a fuel delivery vehicle, said manifold comprising:

structure having a plurality of ports adapted to be in fluid communication with corresponding compartments of a fuel delivery vehicle, a collector conduit common to said ports, a plurality of control valves, each of which is associated with a corresponding port, and each having an open operational condition communicating the corresponding port with said conduit to permit flow of product from the associated compartment to deliver the product, and a normally closed operational condition precluding product flow, and a control system responsive to operator selection for operating each of said control valves independently, said control system including a logic controller responsive to selection of a desired product for opening a corresponding control valve and permitting delivery of said desired product exclusively from the associated compartment, and precluding delivery of products from the other of said compartments.

2. The manifold as set forth in claim 1 wherein said ports of said structure are spaced-apart and connected by said collector conduit.

3. The manifold as set forth in claim 1 wherein said collector conduit includes a plurality of pipe sections, each of said pipe sections extending between a pair of adjacent ports and presenting a continuous pipe.

4. The manifold as set forth in claim 3 wherein at least one of said plurality of pipe sections is transparent.

5. The manifold as set forth in claim 1 wherein each of said plurality of control valves includes a visual position indicator to indicate the operational condition of the corresponding control valve.

6. The manifold as set forth in claim 1 further comprising an operator interface connected with said control system and adapted to be mounted to said fuel delivery vehicle remote from said control system for providing operator input to said control system.

7. The manifold as set forth in claim 1 wherein said control system permits dispensing of the same product from separate tank compartments in the collector conduit simultaneously during delivery of said desired product.

8. The manifold as set forth in claim 1 wherein said control system permits mixing of similar products from separate tank compartments in the collector conduit sequentially during delivery of said desired product.

9. The manifold as set forth in claim 1 wherein said control system prevents mixing of dissimilar products from separate tank compartments in said collector conduit during delivery of said desired product.

10. The manifold as set forth in claim 1 further comprising a second collector conduit common to each of said ports.

11. A fuel delivery system for use with a plurality of tank compartments of a fuel delivery vehicle comprising:

a manifold including structure having a plurality of ports adapted to be in fluid communication with corresponding compartments of a fluid delivery vehicle, a plurality of bottom loading valves secured to said structure in fluid communication with corresponding ports of said structure, a collector conduit common to said ports, a plurality of control valves, each of which is associated with a corresponding port, and each having an open condition communicating the corresponding port with said conduit to permit flow of product from the associated compartment to deliver the product, and a normally closed condition precluding product flow, a guard bar pivotally secured to said structure and having a locked position preventing access to and operation of said bottom loading valves, and an open position permitting access to and operation of said bottom loading valves, and a control system responsive to operator selection for operating each of said control valves individually to open a selected control valve and permit delivery of a desired product exclusively from the corresponding compartment.

12. The fuel delivery system as set forth in claim 11 further comprising a operator releasable catch to retain said guard bar in said locked position.

13. The fuel delivery system as set forth in claim 11 further comprising a locking element responsive to said control system, said locking element having an extended position engaging said guard bar and locking said guard bar in said locked position, and a retracted position permitting said guard bar to be moved to said open position.

14. The fuel delivery system as set forth in claim 13 further comprising a first locking magnet secured to said structure and a second locking magnet secured to said guard bar, said first magnet aligned with and engaging said second magnet when said guard bar is in said locked position to maintain a space between said guard bar and said locking element and to reduce stress on said locking element.

15. The manifold as set forth in claim 11 wherein said ports of said structure are spaced-apart and connected by said collector conduit.

16. The manifold as set forth in claim 11 wherein said collector conduit includes a plurality of pipe sections, each of said pipe sections extending between a pair of adjacent ports and presenting a continuous pipe.

17. The manifold as set forth in claim 16 wherein at least one of said plurality of pipe sections is transparent.

18. The manifold as set forth in claim 11 wherein each of said plurality of control valves includes a visual position indicator to indicate the operational condition of the corresponding control valve.

19. The manifold as set forth in claim 11 wherein said collector conduit includes a generally wedge-shaped collector plug to aid in draining the collector conduit of product.

20. The manifold as set forth in claim 11 further comprising an operator interface connected with said control system and adapted to be mounted to said fuel delivery vehicle remote from said control system for providing operator input to said control system.

21. The manifold as set forth in claim 11 wherein said control system permits dispensing of the same product from separate tank compartments in the collector conduit simultaneously during delivery of said desired product.

22. The manifold as set forth in claim 11 wherein said control system permits mixing of similar products from separate tank compartments in the collector conduit sequentially during delivery of said desired product.

23. The manifold as set forth in claim 11 wherein said control system prevents mixing of dissimilar products from separate tank compartments in said collector conduit during delivery of said desired product.

24. The manifold as set forth in claim 11 further comprising a plurality of product grade indicators associated with respective compartments, said product grade indicators electrically connected to said control system to provide input to said control system to identify the product in each of the corresponding compartments.

25. The manifold as set forth in claim 24 wherein each of said product grade indicators includes an indicator movable between at least two positions and an encoder responsive to said indicator for identifying each of said positions to said control system.

26. The manifold as set forth in claim 24 wherein each of said product grade indicators includes a display and a selector for causing the display to identify the product in the associated compartment and to identify said product to said control system.

27. The manifold as set forth in claim 24 wherein each of said product grade indicators includes an indicator rotatable between at least two positions, one or more magnets mounted to said indicator and one or more magnetically actuated switches aligned with a corresponding magnet and responsive to rotation of said indicator between said at least two positions for identifying said position to said control system.

28. The manifold as set forth in claim 11 further comprising a second collector conduit common to each of said ports.

29. The manifold as set forth in claim 11 further comprising a product delivery hose having a first end connected with said collector conduit and a free end, and a plurality of return spouts associated with respective ports, each of said return spouts being adapted to receive said free end of said delivery hose to provide a means to return product remaining in said product delivery hose to the compartment corresponding to the delivered product.

30. The manifold as set forth in claim 29 further comprising a return spout bar pivotally secured to said structure, said return spout bar having a closed position for preventing access to said return spouts and an open position for permitting access to said return spouts.

31. The manifold as set forth in claim 30 further comprising a valve switch responsive to said return spout bar and providing a closed signal indicating that said return spout bar is in said closed position, and an open signal indicating that said return spout bar is in said open position.

32. In combination with the manifold as set forth in claim 31, a product delivery meter for registering the quantity of product delivered, and wherein said control system is responsive to said open signal from said valve switch to disable said product delivery meter.

33. The manifold as set forth in claim 29 wherein each of said return spouts includes a sight glass.

34. A manifold for use with a plurality of tank compartments of a fuel delivery vehicle, said manifold comprising:

structure having a plurality of ports adapted to be in fluid communication with corresponding compartments of a fuel delivery vehicle, a collector conduit common to said ports, a plurality of control valves, each of which is associated with a corresponding port, and each having an open operational condition communicating the corresponding port with said conduit to permit flow of product from the associated compartment to deliver the product, and a normally closed operational condition precluding product flow, a control system responsive to operator selection for operating each of said valves individually to open a selected control valve and permit delivery of a desired product exclusively from the corresponding compartment, and a plurality of product grade indicators associated with respective compartments, each of said product grade indicators electrically connected to said control system to provide input to said control system to identify the product in the corresponding compartment.

35. The manifold as set forth in claim 34 wherein each of said product grade indicators includes an indicator movable between at least two positions and an encoder responsive to said indicator for identifying each of said positions to said control system.

36. The manifold as set forth in claim 34 wherein each of said product grade indicators includes a display and a selector for causing the display to identify the product in the associated compartment and to identify said product to said control system.

37. The manifold as set forth in claim 34 wherein each of said product grade indicators includes an indicator rotatable between at least two positions, one or more magnets mounted to said indicator and one or more magnetically actuated switches aligned with a corresponding magnet and responsive to rotation of said indicator between said at least two positions for identifying said position to said control system.

38. A manifold for use with a plurality of tank compartments of a fuel delivery vehicle, said manifold comprising:

structure having a plurality of ports adapted to be in fluid communication with corresponding compartments of a fuel delivery vehicle, a collector conduit common to said ports, a plurality of control valves, each of which is associated with a corresponding port, and each having an open operational condition communicating the corresponding port with said conduit to permit flow of product from the associated compartment to deliver the product, and a normally closed operational condition precluding product flow, a product delivery hose having a first end connected with said collector conduit and a free end, and a plurality of return spouts associated with respective ports, each of said return spouts being adapted to receive said free end of said delivery hose to provide a means to return product remaining in said product delivery hose to the compartment corresponding to the delivered product, and a control system responsive to operator selection for operating each of said valves individually to open a selected valve and permit delivery of a desired product exclusively from the corresponding compartment.

39. The manifold as set forth in claim 38 further comprising a return spout bar pivotally secured to said structure, said return spout bar having a closed position for preventing access to said return spouts and an open position for permitting access to said return spouts.

40. The manifold as set forth in claim 39 further comprising a valve switch responsive to said return spout bar arm and providing a closed signal indicating that said return spout bar is in said closed position, and an open signal indicating that said return spout bar is in said open position.

41. In combination with the manifold as set forth in claim 40, a product delivery meter for registering the quantity of product delivered, and wherein said control system is responsive to said open signal from said valve switch to disable said product delivery meter.

42. The manifold as set forth in claim 38 wherein each of said return spouts includes a sight glass.

43. A manifold for use with a plurality of tank compartments of a fuel delivery vehicle, said manifold comprising:

structure having a plurality of ports adapted to be in fluid communication with corresponding compartments of a fuel delivery vehicle, a collector conduit common to said ports and including a generally wedge-shaped collector plug to aid in draining the collector conduit of product, a plurality of control valves, each of which is associated with a corresponding port, and each having an open operational condition communicating the corresponding port with said conduit to permit flow of product from the associated compartment to deliver the product, and a normally closed operational condition precluding product flow, and a control system responsive to operator selection for operating each of said valves individually to open a selected valve and permit delivery of a desired product exclusively from the corresponding compartment.

* * * * *